US011046898B1

(12) United States Patent
Koseoglu et al.

(10) Patent No.: US 11,046,898 B1
(45) Date of Patent: Jun. 29, 2021

(54) SYSTEMS AND PROCESSES FOR SEPARATING AND UPGRADING HYDROCARBONS INTEGRATING A REFINERY SYSTEM WITH STEAM CRACKING OF AN AROMATIC BOTTOMS STREAM

(71) Applicant: Saudi Arabian Oil Company, Dhahran (SA)

(72) Inventors: Omer Refa Koseoglu, Dhahran (SA); Robert Peter Hodgkins, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/874,866

(22) Filed: May 15, 2020

(51) Int. Cl.

| | |
|---|---|
| ***C10G 63/04*** | (2006.01) |
| ***C10G 7/00*** | (2006.01) |
| ***C10G 35/04*** | (2006.01) |
| ***C10G 9/36*** | (2006.01) |

(52) U.S. Cl.
CPC ..... *C10G 63/04* (2013.01); *C10G 7/00* (2013.01); *C10G 9/36* (2013.01); *C10G 35/04* (2013.01); *C10G 2300/1096* (2013.01); *C10G 2300/807* (2013.01); *C10G 2400/30* (2013.01)

(58) Field of Classification Search
CPC ..... C10G 65/12; B01D 3/00
USPC ..... 208/70, 80, 85, 92, 107, 143, 177; 585/448, 800; 196/46
See application file for complete search history.

(56) References Cited

U.S. PATENT DOCUMENTS

| | | | | |
|---|---|---|---|---|
| 4,053,388 | A * | 10/1977 | Bailey | C07C 15/08 208/89 |
| 8,889,943 | B2 * | 11/2014 | Rhodey | C07C 5/417 585/833 |
| 9,109,169 | B2 * | 8/2015 | Al-Therwi | C10G 59/00 |
| 10,053,401 | B1 | 8/2018 | Beadle et al. | |
| 10,513,664 | B1 * | 12/2019 | Koseoglu | C10G 65/18 |
| 10,526,553 | B2 * | 1/2020 | Ward | C10G 69/00 |
| 2004/0218547 | A1 * | 11/2004 | Rhodey | C07C 5/415 370/254 |
| 2008/0194900 | A1 * | 8/2008 | Bhirud | C10G 65/16 585/648 |
| 2013/0261365 | A1 | 10/2013 | Wang et al. | |
| 2016/0369188 | A1 * | 12/2016 | Housmans | C10G 67/0445 |
| 2017/0058214 | A1 * | 3/2017 | Oprins | C10G 69/06 |
| 2018/0066197 | A1 * | 3/2018 | Koseoglu | C10G 69/00 |
| 2018/0155638 | A1 * | 6/2018 | Al-Ghamdi | C10G 69/00 |

(Continued)

*Primary Examiner* — Nina Bhat
(74) *Attorney, Agent, or Firm* — Dinsmore & Shohl LLP

(57) ABSTRACT

A process for separating and upgrading a hydrocarbon feed includes passing the hydrocarbon feed to a distillation unit to separate it into at least a naphtha stream and a residue, passing the naphtha stream to a NHT that hydrotreats the naphtha stream to produce a hydrotreated naphtha, passing the hydrotreated naphtha to an NREF that reforms the hydrotreated naphtha to produce a reformate, passing the reformate to an ARC that processes the reformate to produce at least one aromatic product effluent and an aromatic bottoms stream, and passing at least a portion of the aromatic bottoms stream comprising C9+ aromatic compounds to a steam cracking unit. The steam cracking unit may further upgrade the aromatic bottoms stream, which may increase the yields of greater value chemical intermediates and fuel blending components from the process. Systems for conducting the process are also described.

20 Claims, 5 Drawing Sheets

(56) References Cited

U.S. PATENT DOCUMENTS

| | | | | |
|---|---|---|---|---|
| 2018/0155642 | A1* | 6/2018 | Al-Ghamdi | C10G 11/02 |
| 2019/0055483 | A1* | 2/2019 | Bafna | C10G 69/06 |
| 2021/0102129 | A1* | 4/2021 | Hodgkins | C10G 45/44 |

* cited by examiner

SYSTEMS AND PROCESSES FOR SEPARATING AND UPGRADING HYDROCARBONS INTEGRATING A REFINERY SYSTEM WITH STEAM CRACKING OF AN AROMATIC BOTTOMS STREAM

BACKGROUND

Field

The present disclosure relates to systems and processes for separating and upgrading petroleum-based hydrocarbons, in particular, systems and processes integrating refinery systems for separation and upgrading of hydrocarbon feeds, such as crude oil, with steam cracking of an aromatic bottoms stream from the refinery system.

Technical Background

Petrochemical feeds, such as crude oils, can be converted to fuel blending components and chemical products and intermediates such as olefins and aromatic compounds, which are basic intermediates for a large portion of the petrochemical industry. Crude oil is conventionally processed by distillation followed by various cracking, solvent treatment, and hydroconversion processes to produce a desired slate of fuels, lubricating oil products, chemicals, chemical feedstocks and the like. An example of a conventional refinery process includes distillation of crude oil by atmospheric distillation to recover gas oil, naphtha, gaseous products, and an atmospheric residue. Streams recovered from crude oil distillation at the boiling point of fuels customarily have been further processed to remove sulfur and other contaminants and upgraded to produce various fuel blending components.

Catalytic reformers are the workhorses of refineries to upgrade various naphtha fractions from atmospheric distillation to produce a reformate, which is an aromatic rich gasoline blending fraction or feedstock for aromatics production, such as production of benzene, toluene, and xylenes (BTX). Due to stringent fuel specifications implemented or being implemented worldwide, requiring less than 35 V % aromatics and less than 1 V % benzene in gasoline, the reformate fraction is further treated to reduce its aromatics content. The treatment options available are benzene hydrogenation and aromatics (BTX) recovery. In the first option, reformate is hydrogenated to reduce the benzene content and the total aromatics content is reduced by blending if needed. In the latter option, reformate is passed to an aromatic recovery complex (ARC) to recover the aromatics such as benzene, toluene, and xylenes (BTX), which have premium chemical value. The ARC may also produce a gasoline blending component that is free of benzene and other aromatic compounds. The ARC produces a reject stream or aromatic bottoms that is very heavy (boiling in the range of from 150 degrees Celsius (° C.) to 450° C.) and is not suitable as a gasoline blending component.

Refinery products used for fuels are receiving increasing levels of attention. Product specifications are being scrutinized by governmental agencies, whose interests include decreased emissions from mobile and stationary sources, and by the industries that produce the engines and vehicles that utilize these fuels. Regional and national regulations have been in place and continue to evolve concerning gasoline specifications, and automakers have proposed a set of limitations for gasoline and diesel to allow them to manufacture vehicles that will produce significantly lower emissions over their lifetime. Maximum sulfur, aromatics, and benzene levels of 10 parts per million by weight, 35 volume percent (vol. %), and 1 vol. % or less, respectively, have been targeted as goals by regulators.

Historically, lead was commonly added to gasoline to increase octane. When the use of lead was phased out due to environmental concerns, no direct substitute existed, and refiners instead have converted certain hydrocarbon molecules used in gasoline blending in order to achieve higher octane ratings. Catalytic reforming, which involves a variety of reactions in the presence of one or more catalysts and recycle and make-up hydrogen, is a widely used process for refining hydrocarbon mixtures to increase the yield of higher octane gasoline.

Although benzene yields can be as high as 10 vol. % in reformates, no more than 1-3 vol. % can be present in typical gasoline pools, with certain geographic regions targeting a benzene content of less than 1 vol. % benzene. There currently exists methods to remove benzene from reformate, including separation processes and hydrogenation reaction processes. In separation processes, benzene can be extracted with a solvent and then separated from the solvent in a membrane separation unit or other suitable unit operation. In hydrogenation reaction processes, the reformate is divided into fractions to concentrate the benzene, and then one or more benzene-rich fractions are hydrogenated.

SUMMARY

One problem faced by refineries is how to most economically reduce the benzene content in the reformate products sent to the gasoline pool by improving the systems and processes for upgrading crude oil to reformate products. In some refineries, an aromatic bottoms stream, which is produced by an aromatic recovery complex used for processing the reformate, may be added to the gasoline fraction. However, the aromatic bottoms stream may deteriorate the gasoline quality and over time may impact engine performance negatively.

Accordingly, there is an ongoing need for systems and processes for separating and upgrading crude oil to increase yield and production of valuable products and intermediates, such as gasoline blending components, benzene, toluene, xylenes, or combinations of these. In particular, there is an ongoing need for systems and processes for further converting the aromatic bottoms stream from an aromatics recovery complex into valuable products and intermediates, such as gasoline blending components, toluene, benzene, xylenes, or combinations of these. The present disclosure is directed to systems and processes for separating and upgrading crude oil that integrates a separation and catalytic reforming crude oil with steam cracking of the aromatic bottom stream in a steam cracking system.

The systems described in the present disclosure for separating and upgrading hydrocarbon feeds, such as crude oil, may include a distillation system, such as an atmospheric distillation unit (ADU), in fluid communication with the inlet stream comprising the hydrocarbon feed. The hydrocarbon feed may be passed to the ADU, which may separate the hydrocarbon feed into at least a naphtha stream and an atmospheric residue. The system may include a naphtha hydrotreating unit (NHT) in fluid communication with the ADU. The naphtha stream may be passed to the NHT, which may hydrotreat the naphtha stream with hydrogen in the presence of at least one hydrotreating catalyst to produce a hydrotreated naphtha. The system may further include a naphtha reforming unit (NREF) disposed downstream of and in fluid communication with the NHT. The hydrotreated naphtha may be passed to the NREF, which may reform the hydrotreated naphtha from the NHT to produce a reformate and a hydrogen stream. The system can further include an aromatics recovery complex (ARC), which may be disposed downstream of the NREF and may be in fluid communication with the NREF. The reformate may be passed to the ARC, which processes the reformate to produce at least one aromatic product, an aromatic bottoms stream, and optionally a gasoline pool stream. The aromatic bottoms stream may comprise low-value heavy aromatic compounds, such as C9+ aromatic compounds. The system may further include a steam cracking system disposed downstream of the ARC. The aromatic bottom stream may be passed to the steam cracking system, which may steam crack the lesser-value heavy aromatic compounds from the aromatic bottom stream to produce greater value products and intermediates. Integration of the steam cracking system with the NREF and ARC may increase the yield of greater value products and intermediates, such as but not limited to gasoline blending components, benzene, toluene, xylenes, or combinations of these, from the system through further conversion of the lesser value heavy aromatic compounds in the aromatic bottoms stream.

According to at least one aspect of the present disclosure, a process for separating and upgrading a hydrocarbon feed may include passing the hydrocarbon feed to a distillation system that may separate the hydrocarbon feed into at least a naphtha stream and a residue, passing the naphtha stream to a naphtha hydrotreating unit to hydrotreat the naphtha stream to produce a hydrotreated naphtha, passing the hydrotreated naphtha to a naphtha reforming unit that may reform the hydrotreated naphtha to produce at least a reformate, passing the reformate to an aromatics recovery complex that may process the reformate to produce at least one aromatic product effluent and an aromatic bottoms stream, passing at least a portion of the aromatic bottoms stream to a steam cracking unit to crack at least a portion of the aromatic bottoms stream to produce a steam cracking effluent comprising light hydrocarbon gases, pyrolysis fuel oil, gasoline blending components, benzene, toluene, xylenes, or combinations of these.

According to at least another aspect of the present disclosure, a system for upgrading a hydrocarbon feed, such as crude, may include a distillation system operable to separate the hydrocarbon feed into at least a naphtha stream and a residue, a naphtha hydrotreating unit disposed downstream of the distillation system and operable to contact the naphtha stream with hydrogen in the presence of at least one hydrotreating catalyst to produce a hydrotreated naphtha, a naphtha reforming unit disposed downstream of the naphtha hydrotreating unit and operable to reform the hydrotreated naphtha to produce a reformate, an aromatics recovery complex disposed downstream of the naphtha reforming unit and operable to separate the reformate into at least one aromatic product effluent and an aromatic bottoms stream, and a steam cracking unit downstream of the aromatics recovery complex and operable to receive at least a portion of the aromatic bottoms stream and crack at least a portion of C9+ aromatic compounds from the aromatic bottoms stream to produce a steam cracking effluent comprising one or more of light hydrocarbon gases, gas oil, gasoline blending components, benzene, toluene, mixed xylenes, or combinations of these.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
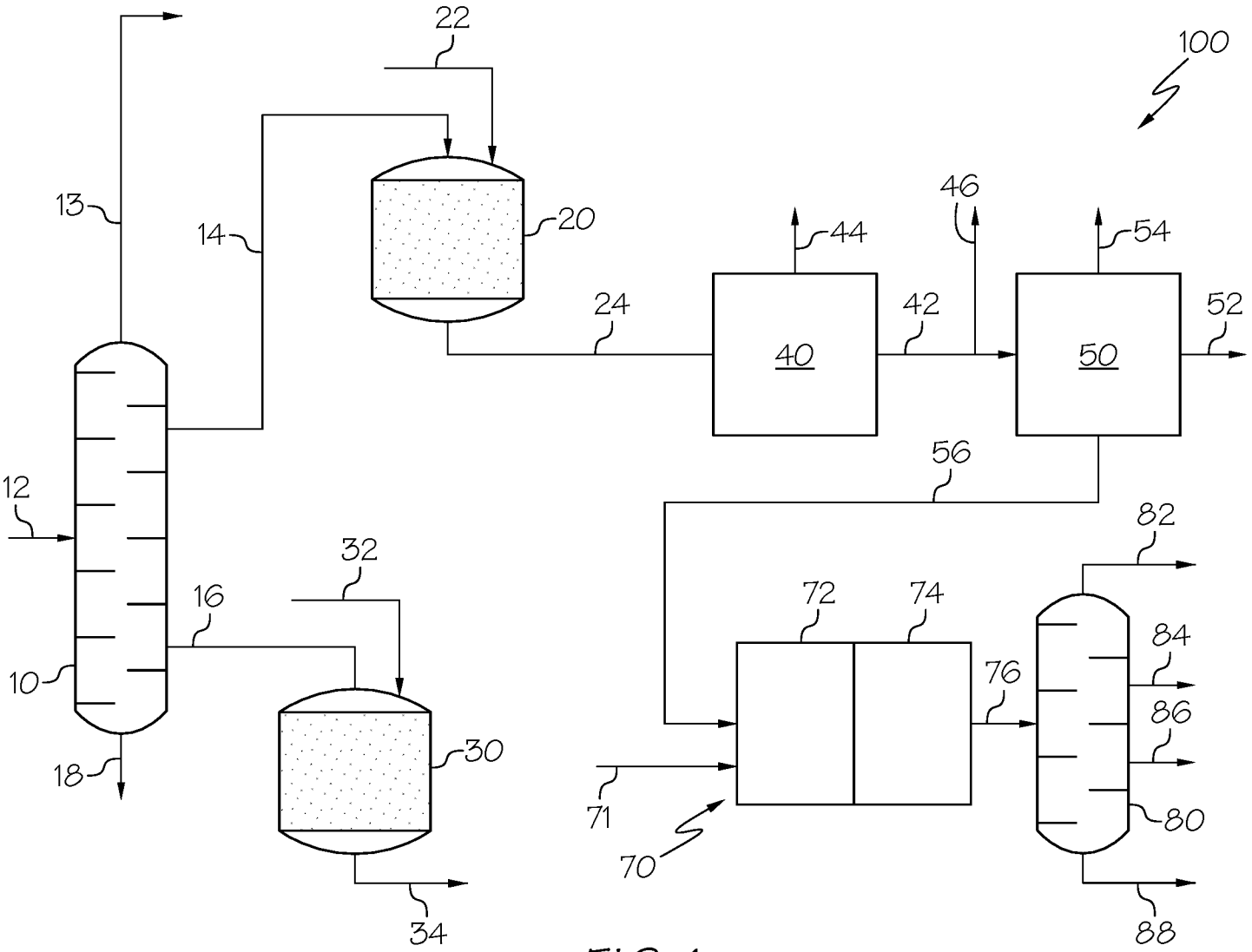
FIG. 1 schematically depicts a generalized flow diagram of a system for separating and upgrading crude oil, according to one or more embodiments shown and described in this disclosure.

For the purpose of describing the simplified schematic illustrations and descriptions of FIGS. 1-5, the numerous valves, temperature sensors, electronic controllers and the like that may be employed and well known to those of ordinary skill in the art of certain chemical processing operations are not included. Further, accompanying components that are often included in chemical processing operations, such as, for example, air supplies, heat exchangers, surge tanks, or other related systems are not depicted. It would be known that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines, which may serve to transfer process steams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows that do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that two or more process streams are "mixed" or "combined" when two or more lines intersect in the schematic flow diagrams of FIGS. 1-5. Mixing or combining may also include mixing by directly introducing both streams into the same reactor, separation device, or other system component. For example, it should be understood that when two streams are depicted as being combined directly prior to entering a separation unit or reactor, that in some embodiments the streams could equivalently be introduced into the separation unit or reactor individually and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

The present disclosure is directed to systems and methods for separating and upgrading hydrocarbon feeds, such as crude oil, to produce more valuable products and chemical intermediates, such as fuel blending components, aromatic compounds, olefins, or combinations of these. Referring to FIG. 1, one embodiment of a system 100 for upgrading a hydrocarbon feed 12 comprising crude oil or other heavy oil is schematically depicted. The system 100 may include a distillation system comprising one or more distillation units, such as an atmospheric distillation unit (ADU) 10, which may separate the hydrocarbon feed 12 into at least a naphtha stream 14 and a residue 18. The system 100 may include a naphtha hydrotreating unit (NHT) 20 disposed downstream of the distillation system. The NHT 20 may contact the naphtha stream 14 with hydrogen 22 in the presence of at least one hydrotreating catalyst to produce a hydrotreated naphtha 24. The system 100 may further include a naphtha reforming unit (NREF) 40 disposed downstream of the NHT 20 and operable to reform the hydrotreated naphtha 24 to produce a reformate 42. The system 100 may include an aromatics recovery unit (ARC) 50 downstream of the NREF 40. The ARC 50 may be operable to process the reformate 42 into at least one aromatic product effluent 52 and an aromatic bottoms stream 56. The system 100 may further include a steam cracking unit 70 disposed downstream of the ARC 50. The steam cracking unit 70 is operable to receive at least a portion of the aromatic bottoms stream 56 and crack at least a portion of C9+ aromatic compounds from the aromatic bottoms stream 56 to produce a steam cracking effluent 76 comprising one or more of light hydrocarbon gases, fuel oil, gasoline blending components, benzene, toluene, xylenes, or combinations of these.

The system 100 may be utilized in a process for separating and upgrading the hydrocarbon feed 12. The process for separating and upgrading the hydrocarbon feed 12 may include passing the hydrocarbon feed 12 to the distillation system that may include the ADU 10 to separate the hydrocarbon feed 12 into at least the naphtha stream 14 and the residue 18, passing the naphtha stream 14 to the NHT 20 that may hydrotreat the naphtha stream 14 to produce the hydrotreated naphtha 24, passing the hydrotreated naphtha 24 to the NREF 40 that may reform the hydrotreated naphtha 24 to produce the reformate 42, and passing the reformate 42 to the ARC 50 that may process the reformate 42 to produce the at least one aromatic product effluent 52 and the aromatic bottoms stream 56. The process further includes passing at least a portion of the aromatic bottoms stream 56 to a steam cracking unit 70 to crack at least a portion of the aromatic bottoms stream 56 to produce a steam cracking effluent 76 comprising one or more of light hydrocarbon gases, fuel oil, gasoline blending components, benzene, toluene, xylenes, or combinations of these. The portion of the aromatic bottoms stream 56 passed to the steam cracking unit 70 may include C9+ aromatic compounds.

The systems and processes of the present disclosure may increase the yield of greater value products and intermediates from the refinery process by further conversion of C9+ aromatic compounds in the aromatic bottoms stream 56 from the ARC 50. In particular, steam cracking of the aromatic bottom stream 56 may increase the yield of greater quality gasoline blending components to meet increasing regulatory standards and may increase the yield of toluene, xylenes, or both, which may be valuable intermediates in the chemical industry. Other greater value products may also be produced through steam cracking the aromatic bottom stream 56 form the ARC 50.

As used in this disclosure, a "reactor" refers to any vessel, container, or the like, in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors such as fixed bed reactors, and fluidized bed reactors. One or more "reaction zones" may be disposed within a reactor. As used in this disclosure, a "reaction zone" refers to an area in which a particular reaction takes place in a reactor. For example, a packed bed reactor with multiple catalyst beds may have multiple reaction zones, in which each reaction zone is defined by the area of each catalyst bed.

As used in this disclosure, a "separation unit" refers to any separation device that at least partially separates one or more chemicals in a mixture from one another. For example, a separation unit may selectively separate different chemical species from one another, forming one or more chemical fractions. Examples of separation units include, without limitation, distillation columns, fractionators, flash drums, knock-out drums, knock-out pots, centrifuges, filtration devices, traps, scrubbers, expansion devices, membranes, solvent extraction devices, high-pressure separators, low-pressure separators, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided or separated into two or more process streams of desired composition.

As used in this disclosure, the term "fractionation" may refer to a process of separating one or more constituents of a composition in which the constituents are divided from each other during a phase change based on differences in properties of each of the constituents. As an example, as used in this disclosure, "distillation" refers to separation of constituents of a liquid composition based on differences in the boiling point temperatures of constituents of a composition.

Further, in some separation processes, a "lesser-boiling effluent" and a "greater-boiling effluent" may separately exit a separation unit. In general, the lesser-boiling effluent has a lesser boiling point temperature than the greater-boiling effluent. Some separation systems may produce a "middle-boiling effluent," which may include constituents having boiling point temperatures between the boiling point temperatures of the lesser-boiling effluent and the greater-boiling effluent. The middle-boiling effluent may be referred to as a middle distillate. Some separation systems may be operable to produce a plurality of streams, each with a different boiling point range. It should be additionally understood that where only one separation unit is depicted in a figure or described, two or more separation units may be employed to carry out the identical or substantially identical separations. For example, where a distillation column with multiple outlets is described, it is contemplated that several separators arranged in series may equally separate the feed stream and such embodiments are within the scope of the presently described embodiments.

As used in this disclosure, the terms "upstream" and "downstream" may refer to the relative positioning of unit operations with respect to the direction of flow of the process streams. A first unit operation of a system may be considered "upstream" of a second unit operation if process streams flowing through the system encounter the first unit operation before encountering the second unit operation. Likewise, a second unit operation may be considered "downstream" of the first unit operation if the process streams flowing through the system encounter the first unit operation before encountering the second unit operation.

As used in the present disclosure, passing a stream or effluent from one unit "directly" to another unit may refer to passing the stream or effluent from the first unit to the second unit without passing the stream or effluent through an intervening reaction system or separation system that substantially changes the composition of the stream or effluent. Heat transfer devices, such as heat exchangers, preheaters, coolers, condensers, or other heat transfer equipment, and pressure devices, such as pumps, pressure regulators, compressors, or other pressure devices, are not considered to be intervening systems that change the composition of a stream or effluent. Combining two streams or effluents together also is not considered to comprise an intervening system that changes the composition of one or both of the streams or effluents being combined.

As used in this disclosure, the term "initial boiling point" or "IBP" of a composition may refer to the temperature at which the constituents of the composition with the least boiling point temperatures begin to transition from the liquid phase to the vapor phase. As used in this disclosure, the term "end boiling point" or "EBP" of a composition may refer to the temperature at which the greatest boiling temperature constituents of the composition transition from the liquid phase to the vapor phase. A hydrocarbon mixture may be characterized by a distillation profile expressed as boiling point temperatures at which a specific weight percentage of the composition has transitioned from the liquid phase to the vapor phase.

As used in this disclosure, the term "effluent" may refer to a stream that is passed out of a reactor, a reaction zone, or a separation unit following a particular reaction or separation. Generally, an effluent has a different composition than the stream that entered the separation unit, reactor, or reaction zone. It should be understood that when an effluent is passed to another system unit, only a portion of that system stream may be passed. For example, a slip stream may carry some of the effluent away, meaning that only a portion of the effluent may enter the downstream system unit. The term "reaction effluent" may more particularly be used to refer to a stream that is passed out of a reactor or reaction zone.

As used in this disclosure, a "catalyst" may refer to any substance which increases the rate of a specific chemical reaction. Catalysts described in this disclosure may be utilized to promote various reactions, such as, but not limited to, hydrodemetalization, hydrodesulfurization, hydrodenitrogenation, hydrodearomatization, hydrocracking, cracking, hydrodearylation, hydrotreating, reforming, isomerization, or combinations thereof. Some catalysts may have multiple forms of catalytic activity, and calling a catalyst by one particular function does not render that catalyst incapable of being catalytically active for other functionality.

As used in this disclosure, "cracking" generally refers to a chemical reaction where a molecule having carbon-carbon bonds is broken into more than one molecule by the breaking of one or more of the carbon-carbon bonds; where a compound including a cyclic moiety, such as an aromatic compound, is converted to a compound that does not include a cyclic moiety; or where a molecule having carbon-carbon double bonds are reduced to carbon-carbon single bonds.

As used throughout the present disclosure, the term "xylenes," when used without a designation of the isomer, such as the prefix para, meta, or ortho (or letters p, m, and o, respectively), may refer to one or more of meta-xylene, ortho-xylene, para-xylene, and mixtures of these xylene isomers.

As used throughout the present disclosure, the term "crude oil" or "whole crude oil" may refer to crude oil received directly from an oil field or from a desalting unit without having any fraction separated by distillation.

It should be understood that the reactions promoted by catalysts as described in this disclosure may remove a chemical constituent, such as only a portion of a chemical constituent, from a process stream. For example, a hydrodemetalization (HDM) catalyst may be present in an amount sufficient to promote a reaction that removes a portion of one or more metals from a process stream. A hydrodenitrogenation (HDN) catalyst may be present in an amount sufficient to promote a reaction that removes a portion of the nitrogen present in a process stream. A hydrodesulfurization catalyst (HDS) catalyst may be present in an amount sufficient to promote a reaction that removes a portion of the sulfur present in a process stream. A hydrodearomatization catalyst may be present in an amount sufficient to promote a reaction that converts aromatics to naphthenes, paraffins, or both. A hydrocracking catalyst may be present in an amount sufficient to promote a reaction that converts aromatic compounds to naphthenes, paraffins, or both, which are greater value fuel products. It should be understood that, throughout this disclosure, a particular catalyst may not be limited in functionality to the removal, conversion, or cracking of a particular chemical constituent or moiety when it is referred to as having a particular functionality. For example, a catalyst identified in this disclosure as a HDN catalyst may additionally provide hydrodearomatization functionality, hydrodesulfurization functionality, or both.

It should further be understood that streams may be named for the components of the stream, and the component for which the stream is named may be the major component of the stream (such as comprising from 50 wt. %, from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "hydrogen stream" passing to a first system component or from a first system component to a second system component should be understood to equivalently disclose "hydrogen" passing to the first system component or passing from a first system component to a second system component.

Referring now to FIG. 1, an embodiment of the system 100 for separating and upgrading the hydrocarbon feed 12 is schematically depicted. As previously discussed, the system 100 can include one or more distillation units (such as the ADU 10), the NHT 20 disposed downstream of the ADU 10, the NREF 40 disposed downstream of the NHT 20, and the ARC 50 disposed downstream of the NREF 40. The system 100 further includes the steam cracking unit 70 downstream of the ARC 50, and a steam cracker separation system 80 downstream of the steam cracking unit 70.

The hydrocarbon feed 12 may include one or more heavy oils, such as but not limited to crude oil, vacuum residue, tar sands, bitumen, other heavy oil streams, or combinations of these. It should be understood that, as used in this disclosure, a "heavy oil" may refer to a raw hydrocarbon, such as whole crude oil, which has not been previously processed through distillation, or may refer to a hydrocarbon oil which has undergone some degree of processing prior to being introduced to the system 100 as the hydrocarbon feed 12. The hydrocarbon feed 12 may have a density of greater than or equal to 0.80 grams per milliliter. The hydrocarbon feed 12 may have an end boiling point (EBP) of greater than 565° C. The hydrocarbon feed 12 may have a concentration of nitrogen of less than or equal to 3,000 parts per million by weight (ppmw).

In one or more embodiments, the hydrocarbon feed 12 may be a crude oil, such as a whole crude oil. The crude oil may have an American Petroleum Institute (API) gravity of from 20 degrees to 50 degrees. For example, the hydrocarbon feed 12 may include a light crude oil, a heavy crude oil, or combinations of these. Example properties for an exemplary grade of Arab light crude oil are listed in Table 1.

TABLE 1

| Example of Arab Light Export Feedstock | | | |
|---|---|---|---|
| Analysis | Units | Value | Test Method |
| American Petroleum Institute (API) gravity | degree | 33.13 | ASTM D287 |
| Density | grams per milliliter (g/mL) | 0.8595 | ASTM D287 |
| Carbon Content | weight percent (wt. %) | 85.29 | ASTM D5291 |

TABLE 1-continued

| Example of Arab Light Export Feedstock | | | |
|---|---|---|---|
| Analysis | Units | Value | Test Method |
| Hydrogen Content | wt. % | 12.68 | ASTM D5292 |
| Sulfur Content | wt. % | 1.94 | ASTM D5453 |
| Nitrogen Content | parts per million by weight (ppmw) | 849 | ASTM D4629 |
| Asphaltenes | wt. % | 1.2 | ASTM D6560 |
| Micro Carbon Residue (MCR) | wt. % | 3.4 | ASTM D4530 |
| Vanadium (V) Content | ppmw | 15 | IP 501 |
| Nickel (Ni) Content | ppmw | 12 | IP 501 |
| Arsenic (As) Content | ppmw | 0.04 | IP 501 |
| Boiling Point Distribution | | | |
| Initial Boiling Point (IBP) | Degrees Celsius (° C.) | 33 | ASTM D7169 |
| 5% Boiling Point (BP) | ° C. | 92 | ASTM D7169 |
| 10% BP | ° C. | 133 | ASTM D7169 |
| 20% BP | ° C. | 192 | ASTM D7169 |
| 30% BP | ° C. | 251 | ASTM D7169 |
| 40% BP | ° C. | 310 | ASTM D7169 |
| 50% BP | ° C. | 369 | ASTM D7169 |
| 60% BP | ° C. | 432 | ASTM D7169 |
| 70% BP | ° C. | 503 | ASTM D7169 |
| 80% BP | ° C. | 592 | ASTM D7169 |
| 90% BP | ° C. | >720 | ASTM D7169 |
| 95% BP | ° C. | >720 | ASTM D7169 |
| End Boiling Point (EBP) | ° C. | >720 | ASTM D7169 |
| BP range C5-180° C. | wt. % | 18.0 | ASTM D7169 |
| BP range 180° C.-350° C. | wt. % | 28.8 | ASTM D7169 |
| BP range 350° C.-540° C. | wt. % | 27.4 | ASTM D7169 |
| BP range > 540° C. | wt. % | 25.8 | ASTM D7169 |

Weight percentages in Table 1 are based on the total weight of the crude oil.

When the hydrocarbon feed 12 comprises a crude oil, the crude oil may be a whole crude or may be a crude oil that has undergone at some processing, such as desalting, solids separation, scrubbing. For example, the hydrocarbon feed 12 may be a de-salted crude oil that has been subjected to a de-salting process. In some embodiments, the hydrocarbon feed 12 may include a crude oil that has not undergone pretreatment, separation (such as distillation), or other operation that changes the hydrocarbon composition of the crude oil prior to introducing the crude oil to the system 100.

Referring again to FIG. 1, the hydrocarbon feed 12 may be introduced to the distillation system. The hydrocarbon feed 12 may be fluidly coupled to the distillation system, such as to the ADU 10, so that the hydrocarbon feed 12 may be introduced to the distillation system. The distillation system may include one or more distillation units or other separation units that, in combination, may separate the hydrocarbon feed 12 into a plurality of streams, such as but not limited to one or more of a light gas stream 13, a naphtha stream 14, a diesel stream 16, an atmospheric residue 18, a light vacuum gas oil (not shown), a heavy gas oil (not shown), a vacuum residue (not shown), or combinations of these.

Referring again to FIG. 1, the distillation system may include the ADU 10. The hydrocarbon feed 12 may be in fluid communication with an inlet of the ADU 10 so that the hydrocarbon feed 12 can be directly introduced to the ADU 10. The ADU 10 may operate to separate the hydrocarbon feed 12 into at least the naphtha stream 14 and the atmospheric residue 18. The ADU 10 may operate to further separate the hydrocarbon feed 12 to produce a light gas stream 13, a diesel stream 16, or other stream in addition to the naphtha stream 14 and the atmospheric residue 18. In embodiments, the ADU 10 may separate the hydrocarbon feed 12 into an ADU tops stream, an ADU middle stream, and an ADU bottoms stream, where the ADU tops stream comprises the naphtha stream 14, the ADU middle stream comprises the diesel stream 16, and the ADU bottoms comprises the atmospheric residue 18. The ADU 10 may include a single fractionation column or may include a plurality of atmospheric distillation units, which may be operated in series or in parallel to separate the hydrocarbon feed 12 into the various streams.

The naphtha stream 14 may include at least 90%, at least 95%, at least 98%, or at least 99% by weight of the constituents of the hydrocarbon feed having an atmospheric boiling point temperature of between 20 degrees Celsius (° C.) to 180° C. The diesel stream 16 may include at least 90%, at least 95%, at least 98%, or at least 99% of the constituents of the hydrocarbon feed 12 having an atmospheric boiling point temperature of between 180° C. to 370° C. The atmospheric residue 18 may include at least 90%, at least 95%, at least 98%, or at least 99% of the constituents of the hydrocarbon feed 12 having an atmospheric boiling point temperature of greater than or equal to 370° C. The light gas stream 13 may include compounds dissolved in the crude oil that are normally gases at atmospheric conditions. The light gas stream 13 may include at least 90%, at least 95%, at least 98%, or even at least 99% of the constituents of the hydrocarbon feed 12 having an atmospheric boiling point temperature of less than or equal to 20° C. The light gas stream 13 may include methane, ethane, propane, butanes, hydrogen sulfide, ammonia, or combinations of these.

The atmospheric residue 18 may be hydroprocessed (not shown) to upgrade the atmospheric residue to greater value products or intermediates or may be further separated by vacuum distillation (not shown) to produce a vacuum residue and one or more vacuum gas oils, such as a light vacuum gas oil, a heavy vacuum gas oil, or both. One or more of the vacuum gas oils may be upgraded through fluidized catalytic cracking or hydrocracking. The vacuum residue may be further processed through hydroprocessing (not shown) to further upgrade the vacuum residue to greater value products and intermediates.

Referring again to FIG. 1, the system may include the NHT 20 disposed downstream of the ADU 10. The NHT may operate to contact the naphtha stream 14 with hydrogen in the presence of at least one hydrotreating catalyst to produce a hydrotreated naphtha 24. The NHT 20 may be in fluid communication with the ADU 10 to receive the naphtha stream 14 from the ADU 10. Hydrogen may be introduced to the NHT 20 through hydrogen stream 22, which may be directly passed to the NHT 20 or combined with the naphtha stream 14 upstream of the NHT 20.

Contact of the naphtha stream 14 with hydrogen in the presence of the hydrotreating catalysts in the NHT 20 may remove at least a portion of the sulfur compounds, nitrogen compounds, or both, from the naphtha stream 14. The NHT 20 may be operated at operating conditions, such as temperature, pressure, hydrogen partial pressure, liquid hourly space velocity (LHSV), and catalyst selection and loading, which are effective to remove at least enough sulfur and nitrogen to meet requisite product specifications. In embodiments, the NHT 20 may be operated under relatively mild conditions that are sufficient to reduce the total concentration of nitrogen compounds and sulfur compounds in the hydrotreated effluent 24 to less than or equal to 0.5 parts per million by weight based on the total weight of the hydrotreated effluent 24.

The hydrotreating catalyst in the NHT 20 is not particularly limited and may include any hydrotreating catalyst capable of hydrotreating the naphtha stream 14 to remove nitrogen compounds or other species having an adverse effect on the NREF 40 downstream of the NHT 20. The hydrotreating catalyst may include one or more metals from Groups 5, 6, or 8-10 of the International Union of Pure and Applied Chemistry periodic table of the elements (IUPAC periodic table), which may be in the form of metals, metal oxides, or metal sulfides. The hydrotreating catalyst may further comprise a support material, such as silica, alumina, titania, or combinations of these, and the metal(s) may be disposed on the support material. In embodiments, the hydrotreating catalyst in the NHT 20 may be a hydrodenitrogenation catalyst (HDN catalyst) that may contain at least one metal from IUPAC Group 6, such as molybdenum, and at least one metal from IUPAC Groups 8-10, such as nickel. The HDN catalyst can also include at least one dopant selected from the group consisting of boron, phosphorus, silicon, halogens, and combinations thereof. Other hydrotreating catalysts are contemplated.

The operating conditions of the NHT 20 are not particularly limited. The NHT 20 may be operated at a hydrotreating temperature of from 250° C. to 400° C., such as from 280° C. to 350° C. The NHT 20 may be operated at a hydrogen partial pressure of from 1 bar (100 kilopascals (kPa)) to 50 bar (5,000 kPa), such as from 20 bar (2,000 kPa) to 40 bar (4,000 kPa). The NHT 20 may operate with a liquid hourly volume space velocity (LHSV) of from 2 per hour ($hr^{-1}$) to 10 $hr^{-1}$, such as from 4 $hr^{-1}$ to 8 $hr^{-1}$. The volume ratio of hydrogen 22 to the naphtha stream 14 introduced to the NHT 20 may be from 50:1 to 300:1.

Referring again to FIG. 1, the system 100 may optionally include a diesel hydrotreating unit (DHT) 30 downstream of the ADU 10. The DHT 30 may be in fluid communication with the ADU 10 to receive the diesel stream 16 from the ADU 10. The DHT 30 may be operable to contact at least a portion of the diesel stream 16 with hydrogen in the presence of at least one hydrotreating catalyst to produce a reduced sulfur diesel 34 having a sulfur content less than the diesel stream 16. Hydrogen may be introduced to the DHT 30 through hydrogen stream 32, which may be directly passed to the DHT 30 or combined with the diesel stream 16 upstream of the DHT 30.

Contact of the diesel stream 16 with hydrogen in the presence of the hydrotreating catalysts in the DHT 30 may remove at least a portion of the sulfur compounds from the diesel stream 16 to produce the reduced sulfur diesel 34 meeting stringent specifications for sulfur content, such as, for example, less than 10 parts per million sulfur by weight (ppmw). The DHT 30 may be operated at operating conditions, such as temperature, pressure, hydrogen partial pressure, liquid hourly space velocity (LHSV), and catalyst selection and loading, which are effective to remove at least enough sulfur to reduce the sulfur content of the reduced sulfur diesel 34 to less than 10 ppmw.

The hydrotreating catalyst in the DHT 30 is not particularly limited and may include any hydrotreating catalyst or combination of hydrotreating catalysts capable of hydrotreating the diesel stream 16 to remove sulfur compounds or other contaminants to produce the low-sulfur diesel 34 meeting quality specifications. The hydrotreating catalyst may include one or more metals from Groups 5, 6, or 8-10 of the International Union of Pure and Applied Chemistry periodic table of the elements (IUPAC periodic table), which may be in the form of metals, metal oxides, or metal sulfides. In embodiments, the hydrotreating catalyst may include one or more metals selected from the group consisting or cobalt (Co), molybdenum (Mo), nickel (Ni), or combinations of these. The hydrotreating catalyst may further comprise a support material, such as silica, alumina, titania, or combinations of these, and the metal(s) may be disposed on the support material. In embodiments, the hydrotreating catalyst in the DHT 30 may include a hydrodesulfurization catalyst (HDS catalyst) comprising one or more metals from Group 6 and one metal from Groups 8-10 of the IUPAC periodic table, which may be present as metals, metal oxides, or metal sulfides, supported on the support material. The HDS catalyst may also contain a dopant that is selected from the group consisting of boron, phosphorus, halogens, silicon, and combinations thereof.

The operating conditions of the DHT 30 are not particularly limited. The DHT 30 may be operated at a hydrotreating temperature of from 300° C. to 420° C., such as from 350° C. to 400° C. The DHT 30 may be operated at a hydrotreating pressure of from 20 bar (2,000 kilopascals (kPa)) to 80 bar (8,000 kPa), such as from 30 bar (3,000 kPa) to 60 bar (6,000 kPa). The DHT 30 may operate with a liquid hourly volume space velocity (LHSV) of from 0.5 per hour ($hr^{-1}$) to 3 $hr^{-1}$, such as from 1 $hr^{-1}$ to 2 $hr^{-1}$. The volume ratio of hydrogen 32 to the diesel stream 16 introduced to the DHT 30 may be from 200:1 to 500:1.

Referring again to FIG. 1, the system 100 may include the NREF 40, which may be disposed downstream of the NHT 20. The NREF 40 may be in fluid communication with the NHT 20 and may receive the hydrotreated effluent 24 from the NHT 20. The hydrotreated effluent 24 may be passed directly from the NHT 20 to the NREF 40 without passing through any intervening reactor or separation system. The NREF 40 may reform the hydrotreated naphtha 24 to increase the octane number to produce a reformate 42 that may be used as a gasoline blending component or as a feed for the ARC 50. The NREF 40 may also produce a separate hydrogen effluent 44. The NREF 40 may include a reformed effluent separation system (not shown) that may be operable to separate an effluent from the reforming reactor into the reformate 42 and the hydrogen effluent 44. The hydrogen effluent 44 may be recovered or may be recycled back to one or more of the NHT 20, the DHT 30, or both of these as at least a portion of the hydrogen streams 22, 32 to those reactors. The hydrogen effluent 44 may also be used as a portion of the hydrogen for hydrocracking the vacuum gas oils or for hydroprocessing the atmospheric residue 18 or a vacuum residue in a residue hydroprocessing unit.

The hydrotreated naphtha 24 may be passed to the NREF 40 to improve its quality, such as by increasing the octane number to produce the reformate 42 that can be used as a gasoline blending stream or feedstock for the ARC 50. Some gasoline blending pools include C4 and heavier hydrocarbons having atmospheric boiling points of less than 205° C. The NREF 40 may be a catalytic reforming process. In catalytic reforming processes, paraffins and naphthenes can be restructured to produce isomerized paraffins and aromatics of relatively higher octane numbers. Catalytic reforming can convert low octane n-paraffins to i-paraffins and naphthenes. Naphthenes can then be converted to higher octane aromatic compounds. The aromatic compounds present in the hydrotreated effluent 24 can remain unchanged or at least a portion of aromatic compounds from the hydrotreated effluent 24 may be hydrogenated to form naphthenes by reverse reactions taking place in the presence of hydrogen. The hydrogen may be generated during reforming of other constituents in the reforming unit and may be present in the reaction mixture.

The chemical reactions involved in catalytic reforming can be grouped into four categories, which include cracking, dehydrocyclization, dehydrogenation, and isomerization. A particular hydrocarbon molecule of the hydrotreated naphtha 24 may undergo one or more than one category of reaction during the reforming process to form one or a plurality of different molecules or products.

The reforming unit of the NREF 40 may contact the hydrotreated naphtha 24 with a reforming catalyst under operating conditions sufficient to cause at least a portion of the hydrotreated naphtha 24 to undergo one or more reactions to produce a reforming effluent, which may then be separated into the reformate 42 and the hydrogen effluent 44. The reforming unit of the NREF 40 may be operated at a temperature of from 400° C. to 560° C., or from 450° C. to 560° C. The reforming unit of the NREF 40 may be operated at a pressure of from 100 kilopascals (kPa) to 5,000 kPa (from 1 bar to 50 bar), or from 100 kPa to 2,000 kPa (from 1 bar to 20 bar). The reforming unit of the NREF 40 may be operated at a liquid hourly space velocity (LHSV) of from 0.5 per hour ($hr^{-1}$) to 4 $h^{-1}$, or from 0.5 $h^{-1}$ to 2 $h^{-1}$.

The reforming catalysts for catalytic reforming processes in the NREF 40 can be either mono-functional or bi-functional reforming catalysts, which can contain precious metals, such as one or more metals from Groups 8-10 of the IUPAC periodic table, as active components (Group VIIIB in the Chemical Abstracts Services (CAS) system). The metals may be supported on a catalyst support, such as but not limited to an alumina, silica, titania, or combinations of these. The reforming catalyst can be a bi-functional catalyst that has both metal sites and acidic sites. In embodiments, the reforming catalyst may be a platinum or palladium supported on an alumina support. The composition of the hydrotreated naphtha 24, the impurities present in the hydrotreated naphtha 24, and the desired products in the reformate 42 may influence the selection of reforming catalyst, reforming process type, and operating conditions. Types of chemical reactions can be targeted by a selection of catalyst or operating conditions known to those of ordinary skill in the art to influence both the yield and selectivity of conversion of paraffinic and naphthenic hydrocarbon precursors to particular aromatic hydrocarbon structures.

The reforming reactor of the NREF 40 may be any one of several types of catalytic reforming process configurations, which differ in the manner in which they regenerate the reforming catalyst to remove the coke formed during the reforming process. Catalyst regeneration, which involves combusting detrimental coke in the presence of oxygen, can include a semi-regenerative process, a cyclic regeneration process, or continuous regeneration process. Semi-regeneration is the simplest configuration, and the entire unit, including all reactors in the series, are shut-down for catalyst regeneration in all reactors. Cyclic configurations utilize an additional "swing" reactor to permit one reactor at a time to be taken off-line for regeneration while the others remain in service. Continuous catalyst regeneration configurations, which are the most complex, provide for continuous operation by catalyst removal, regeneration and replacement. While continuous catalyst regeneration configurations may enable the severity of the operating conditions to be increased due to higher catalyst activity, the associated capital investment is necessarily higher.

Referring again to FIG. 1, the reformed effluent may be separated in a reformed effluent separation system (not shown) to produce the reformate 42 and the hydrogen effluent 44. The reformate 42 may be passed to the ARC 50. At least a portion of the reformate 42 may be sent to the gasoline pool in stream 46 to be blended with other gasoline components to meet the required specifications. As previously discussed, the hydrogen effluent 44 may be passed out of the system and recovered or may be passed (recycled) back to the NHT 20 as all or part of the hydrogen introduced to the NHT 20.

Referring again to FIG. 1, the ARC 50 may be disposed downstream of the NREF 40. The ARC 50 may be in fluid communication with the NREF 40 and may receive all or at least a portion of the reformate 42 from the NREF 40. The ARC 50 may process the reformate 42 to produce at least one aromatic product effluent 52 and an aromatic bottoms stream 56. The ARC 50 may be operable to separate the reformate 42 into the aromatic product effluent 52, a gasoline pool stream 54, and the aromatic bottoms stream 56. The ARC 50 may also be operable to convert one or more aromatic compounds in the reformate 42 to other aromatic compounds, such as xylenes or gasoline pool components.

In the ARC 50, the reformate 42 may be subjected to several processing steps to recover greater value products, such as xylenes and benzene, and to convert lower value products, such as toluene, into greater value products. For example, the aromatic compounds present in the reformate 42 can be separated into different fractions by carbon number, such as but not limited to a C5− fraction, a C6 fraction comprising benzene, a C7 fraction comprising toluene, a C8 fraction including xylenes, and ethylbenzene, and a C9+ fraction (aromatic bottoms stream 56). The C8 fraction may be subjected to one or more operations to convert ethylbenzene, ortho-xylene, and meta-xylene to produce greater yield of para-xylene, which is of greater value. Para-xylene can be recovered in high purity from the C8 fraction by separating the para-xylene from the ortho-xylene, meta-xylene, and ethylbenzene using selective adsorption or crystallization. The ortho-xylene and meta-xylene remaining from the para-xylene separation can be isomerized to produce an equilibrium mixture of xylenes. The ethylbenzene can be isomerized into xylenes or can be dealkylated to benzene and ethane. The para-xylene can then be separated from the ortho-xylene and the meta-xylene using adsorption or crystallization, and the para-xylene-depleted-stream can be recycled to extinction to the isomerization unit and then to the para-xylene recovery unit until all of the ortho-xylene and meta-xylene are converted to para-xylene and recovered.

Toluene can be recovered as a separate fraction, such as a C7 fraction, and then can be converted into greater value products, such as but not limited to benzene or xylenes. One toluene conversion process can include the disproportionation of toluene to make benzene and xylenes. Another toluene conversion process can include the hydrodealkylation of toluene to make benzene. Another toluene conversion process can include the transalkylation of toluene to make benzene and xylenes. Both toluene disproportionation and toluene hydrodealkylation can result in the formation of benzene.

Figure 2:
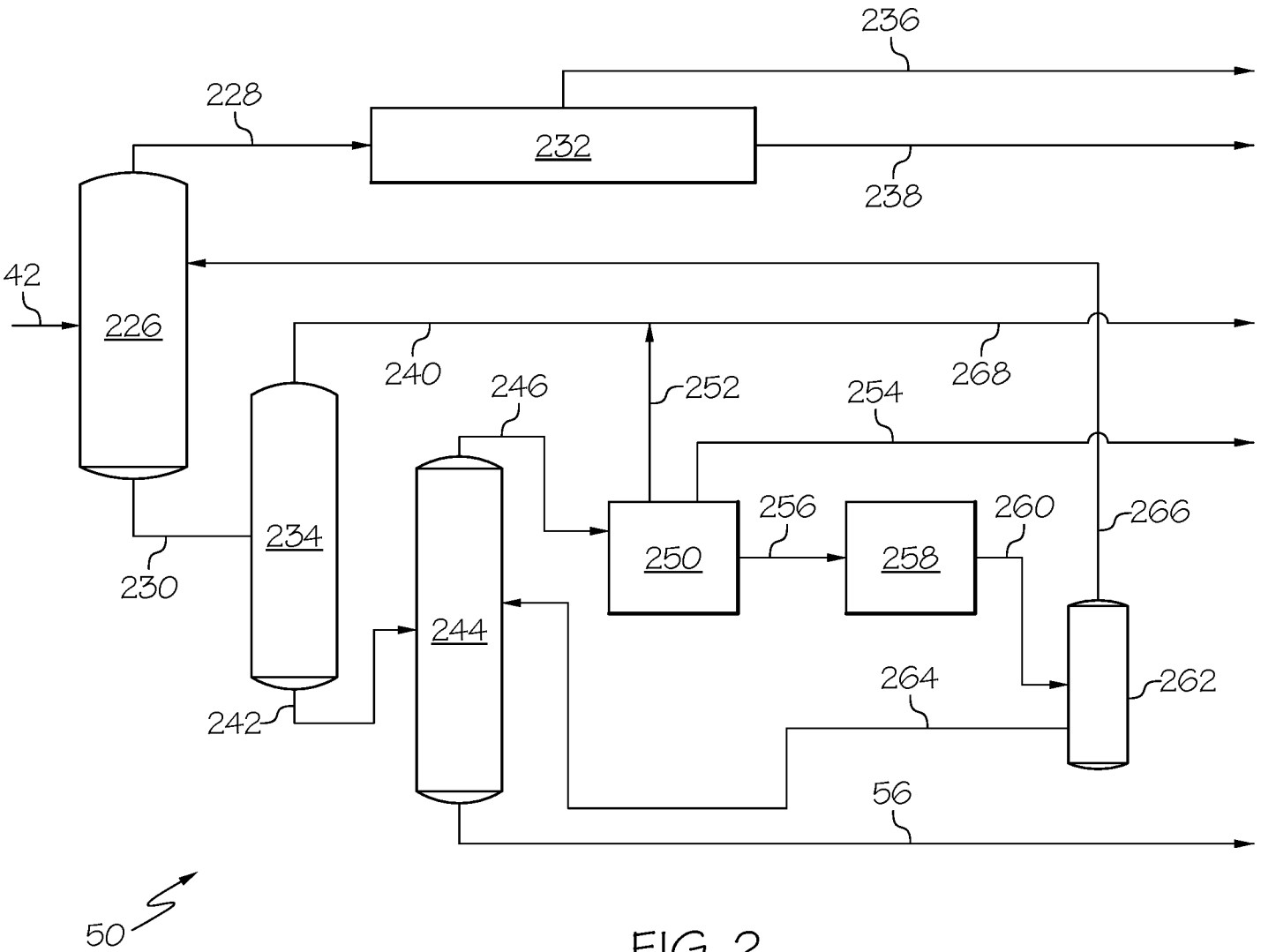
FIG. 2 schematically depicts a generalized flow diagram of an aromatics recovery system of the system for separating and upgrading crude oil of FIG. 1, according to one or more embodiments shown and described in this disclosure.

Referring to FIG. 2, an embodiment of the ARC 50 is schematically depicted. The reformate stream 42 from the NREF 40 (FIG. 1) can be passed to a reformate splitter 226 that can separate the reformate 42 into two fractions: a light reformate stream 228 comprising C5-C6 hydrocarbons, and a heavy reformate stream 230 comprising C7+ hydrocarbons. The light reformate stream 228 may be passed to a benzene extraction unit 232, which may extract the benzene as benzene product in benzene stream 238 and recover substantially benzene-free gasoline in raffinate motor gasoline (mogas) stream 236. The heavy reformate stream 230 may be passed to a splitter 234 which may separate the heavy reformate stream 230 to produce a C7 mogas stream 240 and a C8+ hydrocarbon stream 242. The C8+ hydrocarbon stream 242 may be passed to a deolefinization process to remove olefin compounds from the C8+ hydrocarbon stream 242.

Still referring to FIG. 2, the C8+ hydrocarbon stream 242 may be passed to a xylene rerun unit 244, which may separate the C8+ hydrocarbons stream 242 into a C8 hydrocarbon stream 246 and the aromatic bottoms stream 56, which is a C9+ hydrocarbon stream comprising C9+ hydrocarbons. C8 hydrocarbon stream 246 may be passed to a para-xylene recovery unit 250 that may recover para-xylene as para-xylene product stream 254. The para-xylene recovery unit 250 may also produce a C7 cut mogas stream 252, which may be combined with the C7 cut mogas stream 240 from splitter 234 to produce C7 cut mogas stream 268. Other xylenes (meta-xylene, ortho-xylene, and any trace para-xylene not passed out of unit 250 in the para-xylene product stream 254) may be recovered and passed to a xylene isomerization unit 258 through mixed xylene stream 256. The xylene isomerization unit 258 may isomerize at least a portion of ortho-xylene, meta-xylene, or both, in the mixed xylene stream 256 to para-xylene. The isomerization effluent 260 may be passed from the xylene isomerization unit 258 to a splitter column 262, which may separate the isomerization effluent 260 into a splitter top stream 266 and a splitter bottom stream 264. The splitter bottoms stream 264 may include the para-xylene produced in the xylene isomerization unit 258 as well as the remaining ortho-xylene and meta-xylene. The splitter bottoms stream 264 may be passed back to the xylene rerun unit 244 so that the xylenes can be separated and passed to the para-xylene recovery unit 250 for further recovery of para-xylene. The splitter top stream 266 may be recycled back to reformate splitter 226.

The raffinate mogas stream 236 may be passed out of the ARC 50 as the gasoline pool stream 54 (FIG. 1), which may be passed to the gasoline pool for blending into fuels. The gasoline pool stream 54 comprising the raffinate mogas stream 236 may have less than or equal to 3 volume percent benzene, or less than or equal to 1 volume percent benzene. The one or more aromatic product streams 52 (FIG. 1) passed out of the ARC 50 may include one or more of the benzene stream 238, the para-xylene product stream 254, the C7 cut mogas stream 268, or combinations of these. The aromatic bottoms stream 56 may include the C9+ aromatic compounds from the xylene rerun unit 244 of the ARC 50. The aromatic bottoms stream 56 may include the heavier fraction, such as C9+ alkyl mono-aromatics, and may be a more complex mixture of compounds including di-aromatics. The aromatic bottoms stream 56 may include C9+ aromatic compounds having an atmospheric boiling temperature in a range of from 150° C. to 450° C. Since olefins can be detrimental in the extraction/adsorption process within the ARC 50, olefin compounds may be removed using a deolefinization process or selective hydrogenation. As previously discussed, the C8+ hydrocarbon stream 242 from the splitter 234 may be passed to a deolefinization process to remove olefin compounds from the C8+ hydrocarbon stream 242. Due to the acidic nature of the catalysts used in the deolefinization process, olefinic aromatics such as styrene can react with another aromatic molecule via an alkylation reaction to form bridged di-aromatic molecules. These di-aromatic molecules can end up in the aromatic bottoms stream 56.

The aromatic bottoms stream 56 can include C9+ aromatic compounds from the ARC 50. The aromatic bottoms stream 56 be used as a gasoline blending component. However, the heavy aromatic compounds in the aromatic bottoms stream deteriorates the quality of the gasoline pool when the aromatic bottom stream 56 is used as a gasoline blending component. The heavy aromatic compounds in the aromatic bottom stream 56 may include the C11+ aromatic compounds. In the present disclosure, the aromatic bottoms stream 56 is further processed in a steam cracking system to convert at least some of the aromatic compounds in the aromatic bottom stream 56 to greater value products and intermediates, such as but not limited to pyrolysis gasoline, pyrolysis fuel oils, benzene, toluene, xylenes, light gases, or other greater value chemicals. Steam cracking at least a portion of the aromatic bottoms stream 56 may increase the yield of greater value chemical products and intermediates from the system 100 for separating and upgrading hydrocarbons, such as crude oil.

Referring again to FIG. 1, the system 100 may include a steam cracking system comprising a steam cracking unit 70 downstream of the ARC 50 and a cracked effluent separation system 80 downstream of the steam cracking unit 70. The steam cracking unit 70 may be in fluid communication with the aromatic bottom stream 56 so that the aromatic bottoms stream 56 may be passed from the ARC 50 to the steam cracking unit 70. The aromatic bottoms stream 56 may fluidly couple the ARC 50 to the steam cracking unit 70 so that the aromatic bottoms stream 56 can be passed directly from the ARC 50 to the steam cracking unit 70. The steam cracking unit 70 may be operable to contact the aromatic bottoms stream 56 with steam 71 at a temperature sufficient to cause at least a portion of the hydrocarbons, such as C9+ aromatic compounds, in the aromatic bottoms stream 56 to undergo cracking reactions to produce a steam cracking effluent 76 that may include light gases, pyrolysis gasoline, pyrolysis fuel oils, benzene, toluene, xylenes, or combinations of these.

The steam cracking unit 70 may include a convection zone 72 and a pyrolysis zone 74 disposed downstream of the convection zone 72. The aromatic bottoms stream 56 may pass into the convection zone 72 along with steam 71. The steam 71 may be combined with the aromatic bottoms stream 56 upstream of the convection zone 72 or may be introduced directly to the convection zone 72 and mixed with the aromatic bottoms stream 56 in the convection zone 72. The convection zone 72 may preheat the aromatic bottoms stream 56 and stream 71 to a preheat temperature of from 400° C. to 950° C., from 800° C. to 950° C., from 800° C. to 900° C., or from 850° C. to 900° C. The convection zone 72 may be operated at a pressure of from 1 bar (100 kPa) to 10 bar (1,000 kPa), from 1 bar (100 kPa) to 5 bar (500 kPa), from 1 bar (100 kPa) to 2 bar (200 kPa), or approximately 1.5 bar (150 kPa). The steam 71 may be introduced to the steam cracking unit 70 at a flow rate sufficient to maintain a ratio of steam to hydrocarbon in the steam cracking unit 70 of from 0.3:1 to 2:1 by volume.

The contents of the convection zone 72 may then be passed directly to the pyrolysis zone 74 where hydrocarbons from the aromatic bottoms stream 56 are steam-cracked to produce the steam cracking effluent 76. The steam cracking effluent 76 may be passed out of the pyrolysis zone 74 of the steam cracking unit 70 and through a heat exchanger (not shown), where a process fluid, such as water or pyrolysis fuel oil, may cool the steam cracking effluent 76. The steam cracking effluent 76 may include a mixture of cracked hydrocarbon-based materials, which may be separated into one or more petrochemical products or intermediates included in one or more system product streams. For example, the steam cracking effluent 76 may include one or more of pyrolysis gasoline, pyrolysis fuel oils, benzene, toluene, xylenes, light gases, other products or intermediates, or combinations of these. The steam cracking effluent 76 may additionally include the water from the steam cracking. The pyrolysis zone 74 may operate at a temperature of from 800° C. to 950° C., from 800° C. to 900° C., or from 850° C. to 900° C., and a pressure of from 1 bar (100 kPa) to 10 bar (1,000 kPa), from 1 bar (100 kPa) to 5 bar (500 kPa), from 1 bar (100 kPa) to 2 bar (200 kPa), or approximately 1.5 bar (150 kPa). The residence time of the hydrocarbons from the aromatic bottom stream 56 in the steam cracking unit 70 (convection zone 72 and pyrolysis zone 74) may be from 0.1 second to 1.5 seconds, 0.5 second to 1.5 seconds, 0.3 second to 1.0 second, or approximately 0.7 seconds. As used in the present disclosure, the residence time may refer to the amount of time that the reactants are contacted at the reaction temperature.

Referring again to FIG. 1, the steam cracking effluent 76 may be passed to the steam cracking effluent separation system 80. The steam cracking effluent separation system 80 may be in fluid communication with the steam cracking unit 70 to receive the steam cracking effluent 76 directly from the steam cracking unit 70. The steam cracking effluent separation system 80 may be operable to separate the steam cracking effluent 76 into a plurality of effluent streams, such as but not limited to, a light gas effluent 82, a BTX effluent 84 (comprising benzene, toluene, xylenes, or combinations of these), a pyrolysis gasoline, effluent 86 comprising gasoline blending components, one or more pyrolysis fuel oil effluents 88, or combinations of these. The steam cracking effluent separation system 80 may include one or a plurality of separation units, which, collectively, may be operable to separate the steam cracking effluent 76 into one or more of the light gas effluent 82, the BTX effluent 84, the gasoline blending effluent 86, the pyrolysis fuel oil 88, or combinations of these.

The light gas effluent 82 may include light gases, such as but not limited to light alkanes, olefins, water vapor, carbon monoxide, carbon dioxide, or other light gases. As previously discussed, light gases may refer to gases that are in gaseous form at ambient temperature and pressure. The light gas effluent 82 may include greater than or equal to 95%, greater than or equal to 97%, or even greater than or equal to 99% of the light gases from the steam cracking effluent 76. The light gas effluent 82 may include constituents of the steam cracking effluent 76 having atmospheric boiling point temperatures less than or equal to 20° C. The light gas effluent 82 may be passed to a gas treatment plant for further processing, such as but not limited to separation and purification of hydrogen, recovery of methane and other hydrocarbon gases, or combinations of these.

The BTX effluent 84 may include one or more aromatic compounds, such as but not limited to benzene, toluene, xylene (ortho-xylene, meta-xylene, para-xylene, or combinations of these), ethylbenzene, other aromatic compounds, or combinations of aromatic compounds. The BTX effluent 84 may include greater than or equal to 50%, greater than or equal to 80%, greater than or equal to 90%, greater than or equal to 95%, or even greater than or equal to 98% of the C6-C8 aromatic compounds (benzene, toluene, xylenes, ethylbenzene) from the steam cracking effluent 76. In embodiments, the BTX effluent 84 may include constituents from the steam cracking effluent 76 having atmospheric boiling point temperatures from 20° C. to 145° C. The BTX effluent 84 may be passed out of the system 100 to one or a plurality of processing units downstream of the steam cracking effluent separation system 80 for further separation and purification of the aromatic compounds from the BTX effluent 84. In embodiments, the BTX effluent 84 may be passed back to the ARC 50 for processing and recovery of para-xylene, benzene, or both or may be passed to one or more downstream processes, such as transalkylation unit (not shown), for further processing. Referring again to FIG. 2, when passed to back to the ARC 50, the BTX effluent 84 may be passed to the reformate splitter 226, the splitter 234, or the deolefinization process (not shown) downstream of the splitter 234.

Referring again to FIG. 1, the gasoline blending effluent 86 may include gasoline blending components from the steam cracking effluent 76. The gasoline blending effluent 86 may include greater than or equal to 50%, greater than or equal to 80%, greater than or equal to 90%, greater than or equal to 95%, or even greater than or equal to 98% by weight of the gasoline blending components from the steam cracking effluent 76. The gasoline blending effluent 86 may include constituents of the steam cracking effluent 76 having atmospheric boiling point temperatures of from 145° C. to 180° C. The gasoline blending effluent 86 may include greater than or equal to 50%, greater than or equal to 80%, greater than or equal to 90%, greater than or equal to 95%, or even greater than or equal to 98% by weight of the constituents of the steam cracking effluent 76 having atmospheric boiling point temperatures of from 145° C. to 180° C. The gasoline blending effluent 86 may be passed to the gasoline pool or to one or more processing units downstream of the steam cracking effluent separation system 80 for further processing. In embodiments, the BTX effluent 84 and the gasoline blending effluent 86 may be passed out of the steam cracking effluent separation system 80 as a single combined stream comprising the constituents of the steam cracking effluent 76 having boiling point temperatures of from 20° C. to 180° C. The single combined stream comprising the BTX effluent 84 and gasoline blending effluent 86 may be passed back to the ARC 50 for recovery of gasoline blending constituents and BTX.

Stream cracking the aromatic bottoms stream 56 in the steam cracking unit 70 may increase the yield of greater value chemical intermediates, such as but not limited to benzene, toluene, and xylenes, from the system 100. Stream cracking the aromatic bottom stream 56 may also increase the yield of gasoline blending components from the system 100. The yield of gasoline blending components from the system 100 may be further increased by removing gasoline blending components from the aromatic bottom stream prior to steam cracking the remaining constituents of the aromatic bottoms stream.

Figure 3:
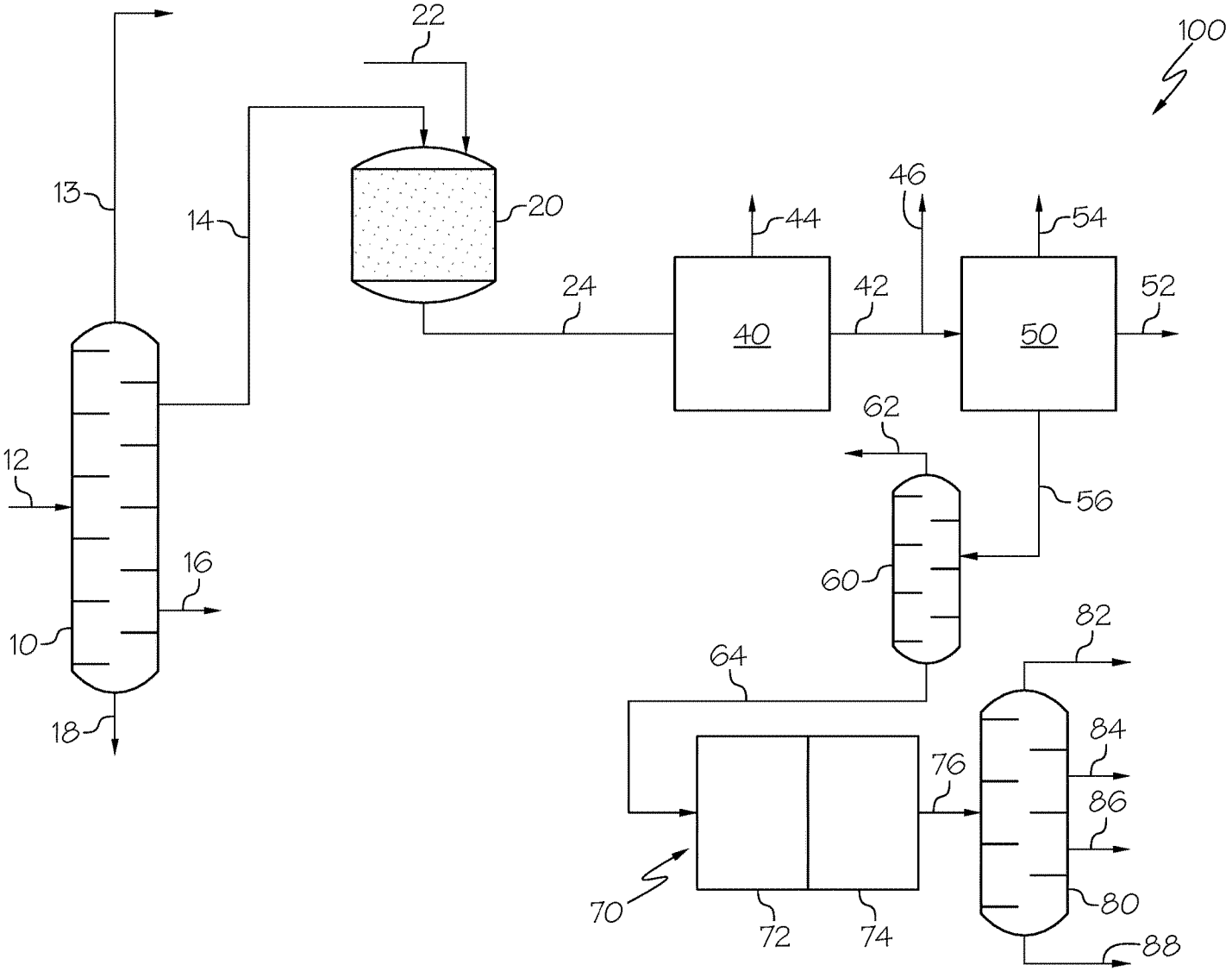
FIG. 3 schematically depicts a generalized flow diagram of another embodiment of a system for separation and upgrading crude oil, according to one or more embodiments shown and described in this disclosure.

Referring now to FIG. 3, the system 100 may include an aromatic bottoms atmospheric distillation unit 60 disposed downstream of the ARC 50 and upstream of the steam cracking unit 70. The aromatic bottoms atmospheric distillation unit 60 may be in fluid communication with the ARC 50 to receive at least a portion of the aromatic bottoms stream 56 from the ARC 50. In embodiments, all of the aromatic bottoms stream 56 may be passed from the ARC 50 to the aromatic bottoms atmospheric distillation unit 60. The aromatic bottoms atmospheric distillation unit 60 may be operable to separate at least a portion of the aromatic bottoms stream 56 to produce at least a lesser boiling effluent 62 and a greater boiling aromatic bottoms effluent 64. The lesser boiling point effluent 62 may include constituents of the aromatic bottoms stream 56 that are suitable as gasoline blending components and may have atmospheric boiling point temperatures less than or equal to a cutpoint temperature of the aromatic bottoms atmospheric distillation unit 62. The lesser boiling effluent 62 may include constituents of the aromatic bottoms stream having boiling point temperatures in the naphtha and gasoline boiling point range, such as constituents having atmospheric boiling point temperatures less than or equal to 180° C. The lesser boiling effluent 62 may be a gasoline pool stream. The lesser boiling effluent 62 may include C9 and C10 aromatic compounds from the aromatic bottom stream 56. The lesser boiling effluent 62 may be passed out of the system 100 to the gasoline pool or to one or downstream processes, such as a transalkylation unit, for further processing.

The greater boiling aromatic bottoms effluent 64 may include constituents of the aromatic bottoms stream 56 having boiling point temperatures greater than the cutpoint temperature of the aromatic bottoms atmospheric distillation unit 60, such as greater than 180° C. The greater boiling aromatic bottoms effluent 64 may include constituents of the aromatic bottoms stream 56 having boiling temperatures greater than the gasoline boiling point range. The greater boiling aromatic bottoms effluent 64 may include C11+ aromatic compounds. The greater boiling aromatic bottoms effluent 64 may include greater than 90%, greater than 95%, greater than 98%, or even greater than 99% by weight of the C11+ aromatic compounds from the aromatic bottoms stream 56.

Referring again to FIG. 3, at least a portion of the greater boiling aromatic bottoms effluent 64 may be passed from the aromatic bottoms atmospheric distillation unit 60 to the steam cracking unit 70 as the feed to the steam cracking unit 70. The steam cracking unit 70 may be in direct fluid communication with an outlet of the aromatic bottoms atmospheric distillation unit 60 so that the greater boiling aromatic bottoms effluent 64 may be passed directly to the steam cracking unit 70. The greater boiling aromatic bottoms effluent 64 may be steam cracked in the steam cracking unit 70 as previously described in the present disclosure. Inclusion of the aromatic bottoms atmospheric distillation unit 60 may remove suitable gasoline blending components from the aromatic bottoms stream 56 so that these components are not further steam cracked in the steam cracking unit 70. This may further increase the yield of gasoline blending components from the system 100 compared to steam cracking the entire aromatic bottoms stream 56.

Figure 4:
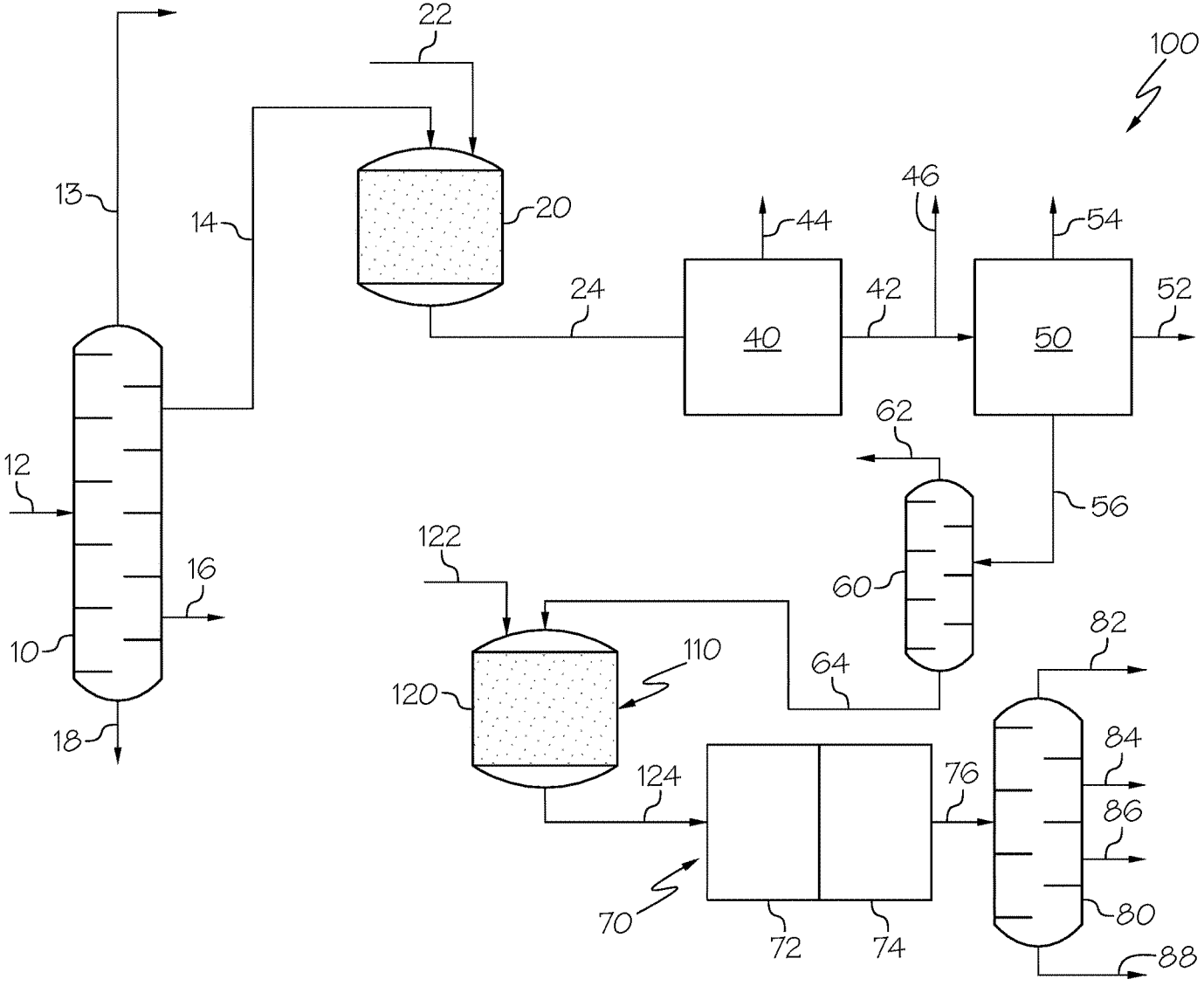
FIG. 4 schematically depicts a generalized flow diagram of still another embodiment of a system for separating and upgrading crude oil, according to one or more embodiments shown and described in this disclosure.

Referring now to FIG. 4, the system 100 may include a hydrodearylation system (HDA) 110 disposed downstream of the aromatic bottoms atmospheric distillation unit 60 and upstream of the steam cracking unit 70. The HDA 110 may be in fluid communication with the aromatic bottoms atmospheric distillation unit 60 and may be operable to receive at least a portion of the greater boiling aromatic bottoms stream 64 from the aromatic bottoms atmospheric distillation unit 60. The greater boiling aromatic bottoms stream 64 may be passed directly from the aromatic bottoms atmospheric distillation unit 60 to the HDA 110. The HDA 110 may be operable to hydrodearylate at least a portion of the greater boiling aromatic bottoms stream 64 to produce a hydrodearylated effluent 124. As used in this disclosure, the term "hydrodearylation" may refer to a process for cleaving of the alkyl bridge of non-condensed alkyl-bridged multi-aromatics or heavy alkyl aromatic compounds to form alkyl mono-aromatics, in the presence a hydrodearylation catalyst and hydrogen. Thus, the HDA 110 may convert at least a portion of the non-condensed alkyl-bridged multi-aromatic compounds from the greater boiling aromatic bottoms stream 64 to monoaromatic compounds. The HDA 110 may be operable to convert at least 1%, at least 30%, at least 50%, at least 60%, or even at least 75% by weight of the non-condensed alkyl-bridged multi-aromatic compounds from the greater boiling aromatic bottoms stream 64 to monoaromatic compounds. The HDA 110 may be operable to convert from 1% to 100%, from 30% to 100%, from 50% to 100%, from 60% to 100%, from 75% to 100%, from 30% to 90%, from 50% to 90%, from 60% to 90%, or from 75% to 90% by weight of the non-condensed alkyl-bridged multi-aromatic compounds from the greater boiling aromatic bottoms stream 64 to monoaromatic compounds. At least a portion of the hydrodearylated effluent 124 may then be passed on to the steam cracking unit 70 for steam cracking.

Referring again to FIG. 4, the HDA 110 may include a hydrodearylation reactor 120. The hydrodearylation reactor 120 may be in fluid communication with the aromatic bottoms atmospheric distillation unit 60 and operable to receive all or a portion of the greater boiling aromatic bottoms stream 64 from the aromatic bottoms atmospheric distillation unit 60. The hydrodearylation reactor 120 may be operable to contact at least a portion of the greater boiling aromatic bottoms stream 64 with hydrogen in the presence of a hydrodearylation catalyst to produce a hydrodearylated effluent 124. The hydrogen may be passed to the hydrodearylation reactor 120 in hydrogen stream 122. The hydrogen stream 122 may include recycled hydrogen, such as a portion of hydrogen effluent 44 from the NREF 40, or supplemental hydrogen from an external hydrogen source inside or outside the battery limits of the refinery. The hydrogen may be passed directly to the hydrodearylation reactor 120 or may be combined with the greater boiling aromatic bottoms stream 64 upstream of the hydrodearylation reactor 120.

The hydrodearylation reactor 120 may include any type of reactor suitable for contacting the portion of the greater boiling aromatic bottoms stream 64 with hydrogen in the presence of the hydrodearylation catalysts. Suitable reactors may include, but are not limited to, fixed bed reactors, moving bed reactors, fluidized bed reactors, plug flow reactors, other type of reactor, or combinations of reactors. In embodiments, the hydrodearylation reactor 120 may include one or more fixed bed reactors, which may be operated in downflow, upflow, or horizontal flow configurations.

The hydrodearylation catalyst in the hydrodearylation reactor 120 can include a catalyst support material made of one or more of silica, alumina, titania, and a combination thereof. The hydrodearylation catalyst in the hydrodearylation reactor 120 can further include an acidic component being at least one member of the group consisting of amorphous silica-alumina, zeolite, and combinations thereof. The zeolite can be one or more of or derived from FAU, *BEA, MOR, MFI, or MWW framework types, wherein each of these codes correspond to a zeolite structure present in the database of zeolite structures as maintained by the Structure Commission of the International Zeolite Association. The hydrodearylation catalyst in the hydrodearylation reactor 120 can include one or more metals from Groups 6-10 of the IUPAC periodic table. The hydrodearylation catalyst may include a metal selected from the group consisting of iron, cobalt, nickel, molybdenum, tungsten, and combinations thereof. The IUPAC Group 8-10 metals can be present in the hydrodearylation catalyst in an amount ranging from 2 to 20 percent by weight of the hydrodearylation catalyst and the IUPAC Group 6 metal can be present in the hydrodearylation catalyst in an amount ranging from 1 to 25 percent by weight of the hydrodearylation catalyst.

The hydrodearylation reactor 120 may contact the greater boiling aromatic bottoms stream 64 with hydrogen in the presence of the hydrodearylation catalyst at operating conditions sufficient to cause at least a portion of the hydrocarbons in the greater boiling aromatic bottoms stream 64 to undergo hydrodearylation to produce the hydrodearylated effluent 124. The hydrodearylation reactor 120 may be operated at an operating temperature in the range of from 200° C. to 450° C., or from 250° C. to 450° C. and an operating pressure of from 100 kPa (1 bar) to 8,000 kPa (80 bar). The hydrodearylation reactor 120 may be operated at a hydrogen partial pressure of from 500 kilopascals (kPA, equal to 5 bar gauge, where 1 bar equals 100 kPa) to 10,000 kPa (equal to 100 bar gauge). The feed rate of hydrogen to the hydrodearylation reactor 120 may be from 100 to 2500 standard liters per liter of feed to the hydrodearylation reactor 120, where the feed can be the aromatic bottoms stream 56 from the ARC 50 or the greater boiling aromatic bottoms stream 64 from the aromatic bottoms atmospheric distillation unit 60. The hydrodearylation reactor 120 may operate at a liquid hourly space velocity (LHSV) of from 0.5 per hour to 10 per hour.

Contacting the greater boiling aromatic bottoms stream 64 with hydrogen in the presence of the hydrodearylation catalyst at the operating conditions of the hydrodearylation reactor 120 may cause at least a portion of the non-condensed alkyl-bridged multi-aromatics compounds or heavy alkyl aromatic compounds to undergo hydrodearylation reactions to cleave at least a portion of the alkyl bridges of these compounds to form mono-aromatic compounds. Referring again to FIG. 4, the hydrodearylation reactor 120 may be in fluid communication with the steam cracking unit 70 to pass the hydrodearylated effluent 124 directly from the hydrodearylation reactor 120 to the steam cracking unit 70.

Figure 5:
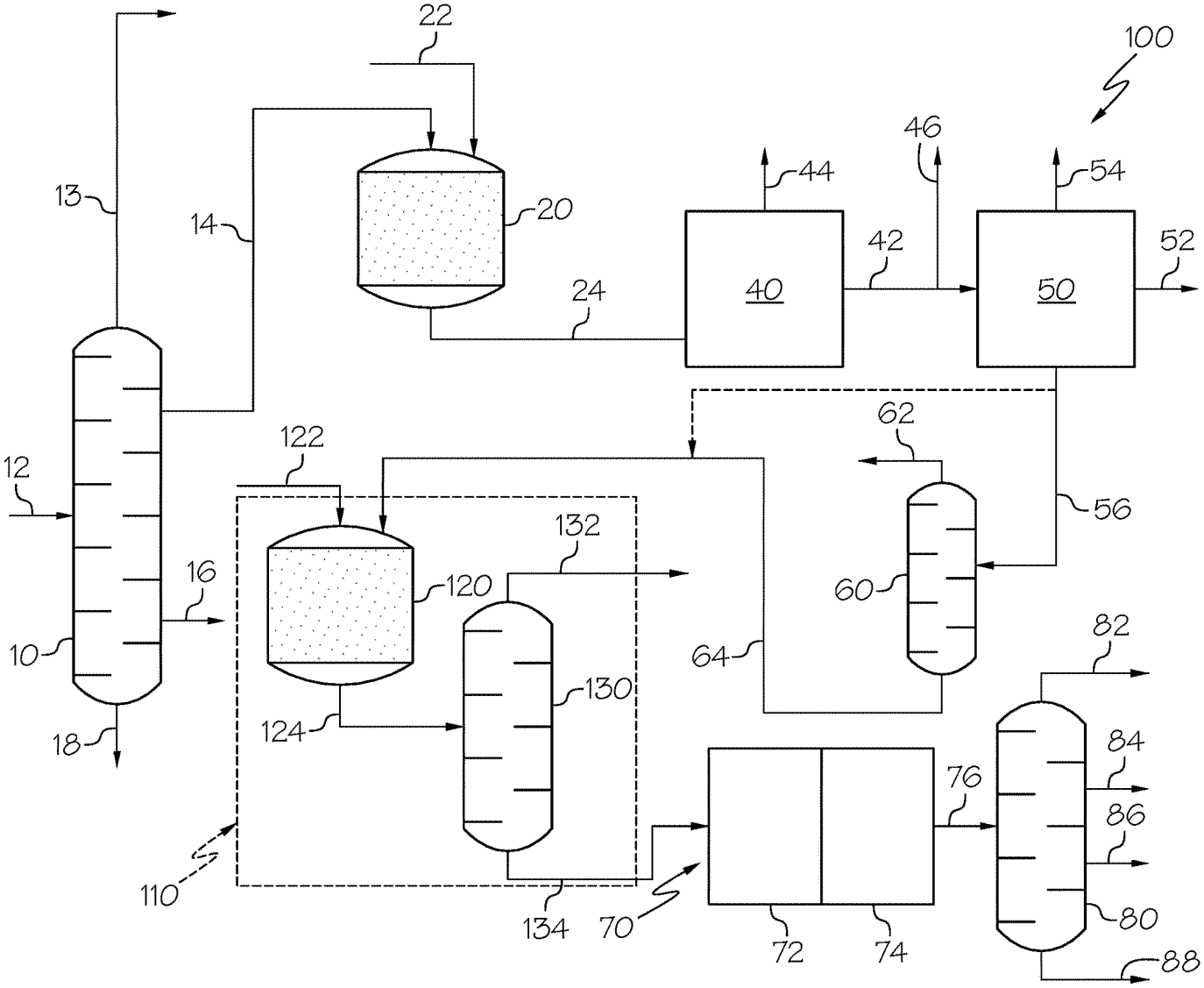
FIG. 5 schematically depicts a generalized flow diagram of still another embodiment of a system for separation and upgrading crude oil according to one or more embodiments shown and described in this disclosure.

Referring now to FIG. 5, the HDA 110 may additionally include a hydrodearylated effluent separation system 130 disposed downstream of the hydrodearylation reactor 120 and upstream of the steam cracking unit 70. The hydrodearylated effluent 124 may be passed from the hydrodearylation reactor 120 to the hydrodearylated effluent separation system 130. The hydrodearylated effluent separation system 130 may be in fluid communication with the hydrodearylation reactor 120 so that the hydrodearylated effluent 124 may be passed directly to the hydrodearylated effluent separation system 130. The hydrodearylated effluent separation system 130 may include one or a plurality of separation units. The hydrodearylated effluent separation system 130 may be operable to separate the hydrodearylated effluent 124 into a gasoline fraction 132 and a hydrodearylation bottoms effluent 134.

The gasoline fraction 132 may include constituents of the hydrodearylated effluent 124 having atmospheric boiling point temperatures in the naphtha/gasoline range, such as atmospheric boiling point temperatures less than or equal to 180° C. The gasoline fraction 132 may include at least 80%, at least 90%, at least 95%, at least 98%, or even at least 99% by weight of constituents of the hydrodearylated effluent 124 having atmospheric boiling point temperatures less than or equal to 180° C. The gasoline fraction 132 may include hydrocarbon compounds having a number of carbon atoms less than or equal to 10. The gasoline fraction 132 may include monoaromatic compounds having less than or equal to 10 carbon atoms, such as but not limited to benzene, toluene, xylenes, ethylbenzene, which may be produced through hydrodearylation in the hydrodearylation reactor 120. The gasoline fraction 132 may be passed out of the system 100. The gasoline fraction 132 may be passed to the gasoline pool or to one or more downstream processes for further processing. The hydrodearylated effluent separation system 130 may separate the constituents suitable for use as gasoline blending components so that they are not further processed in the steam cracking unit. Thus, the hydrodearylated effluent separation system 130 may further increase the yield of gasoline blending components from the system.

The hydrodearylation bottoms effluent 134 may include constituents of the hydrodearylated effluent 124 having atmospheric boiling point temperatures greater than 180° C. The hydrodearylation bottoms effluent 134 may include at least 80%, at least 90%, at least 95%, at least 98%, or even at least 99% by weight of the constituents of the hydrodearylated effluent 124 having atmospheric boiling point temperatures greater than 180° C. The hydrodearylation bottoms stream 134 may include the C11+ aromatic compounds from the hydrodearylated effluent 124. The steam cracking unit 70 may be in fluid communication with an outlet of the hydrodearylated effluent separation system 130 so that the hydrodearylation bottoms stream 134 may be passed directly from the hydrodearylated effluent separation system 130 to the steam cracking unit 70 for steam cracking of the C11+ aromatic compounds.

Referring again to FIG. 5, in embodiments, the hydrodearylation system 110 may be in directly fluid communication with the ARC 50 so that all or a portion of the aromatic bottoms stream 56 may be passed directly to the hydrodearylation system 110. All or at least a portion of the aromatic bottoms stream 56 may be bypassed around the aromatic bottoms atmospheric distillation unit 60 and subjected to hydrodearylation in the hydrodearylation system 110 without first being separated in the aromatic bottoms atmospheric distillation unit 60.

Referring now to FIG. 1, the system 100 may be used to conduct a process for separating and upgrading the hydrocarbon feed 12. In any of the processes described subsequently in this disclosure, the distillation system, such as ADU 10, the NHT 20, the NREF 40, the ARC 50, the aromatic bottoms atmospheric distillation unit 60, the steam cracking unit 70, the steam cracking effluent separation system 80, and the HDA 110 may have any of the features, characteristics, or operating conditions previously described in this disclosure for each of these unit operations. A process for separating and upgrading a hydrocarbon feed 12 may include passing the hydrocarbon feed 12 to the distillation system that may separate the hydrocarbon feed 12 into at least a naphtha stream 14 and a residue 18, passing the naphtha stream 14 to the NHT 20 to hydrotreat the naphtha stream 14 to produce a hydrotreated naphtha 24, passing the hydrotreated naphtha 24 to the NREF 40 that reforms the hydrotreated naphtha 24 to produce at least a reformate 42, and passing the reformate 42 to the ARC 50 that processes the reformate 42 to produce at least one aromatic product effluent 52 and the aromatic bottoms stream 56. The process may further include passing at least a portion of the aromatic bottoms stream 56 to a steam cracking unit 70 to crack at least a portion of the aromatic bottoms stream 56 to produce a steam cracking effluent 76 comprising one or more of light hydrocarbon gases, pyrolysis gasoline, pyrolysis fuel oil, benzene, toluene, xylenes, or combinations of these. The hydrocarbon feed 12 may be crude oil.

Hydrotreating the naphtha stream 14 in the NHT 20 may include contacting the naphtha stream 14 with hydrogen from hydrogen stream 22 in the presence of a hydrotreating catalyst under conditions sufficient to hydrotreat the naphtha stream 14 to produce the hydrotreated naphtha 24 having reduced concentrations of nitrogen compounds, sulfur compounds, or both compared to the naphtha stream 14. Reforming the hydrotreated naphtha 24 may include contacting the hydrotreated naphtha 24 with a reforming catalyst in a reforming reactor under operating conditions sufficient to cause at least a portion of the hydrotreated naphtha 24 to undergo one or more reactions to produce a reforming reaction effluent. Reforming the hydrotreated naphtha stream 24 may further include passing the reforming reaction effluent to a reforming effluent separation system which separates the reforming reaction effluent to produce the reformate 42 and the hydrogen effluent 44. Reforming the hydrotreated naphtha 24 may further include producing a gasoline pool stream. In embodiments, the process may include passing at least a portion of the reformate 42 to the gasoline pool stream. Processing the reformate 42 in the ARC 50 may include recovering at least one aromatic product stream 52. Processing the reformate 42 in the ARC 50 may further include recovering at least a gasoline pool stream from the reformate 42. Processing the reformate 42 may include one or more separation processes, one or more isomerization processes, or both.

In any of the processes described in the present disclosure, the portion of the aromatic bottoms stream 56 passed to the steam cracking unit 70 may include constituents having boiling point temperatures greater than 100° C., greater than 150° C., or even greater than 180° C. The portion of the aromatic bottoms stream 56 passed to the steam cracking unit 70 may include C9+ aromatic compounds. The portion of the aromatic bottoms stream 56 passed to the steam cracking unit 70 may include greater than or equal to 50 weight percent C9+ aromatic compounds based on the total weight of the aromatic bottoms stream 56 passed to the steam cracking unit 70. The portion of the aromatic bottom stream 56 passed to the steam cracking unit 70 may include C11+ aromatic compounds. In embodiments, the portion of the aromatic bottoms stream 56 passed to the steam cracking unit 70 may include greater than or equal to 50 weight percent C11+ aromatic compounds.

Referring again to FIG. 1, any of the process of the present disclosure may further comprise passing the steam cracking effluent 76 to the steam cracking effluent separation system 80 to separate the steam cracking effluent 76 into at least a BTX effluent 84, a gasoline blending effluent 86, at least one pyrolysis fuel oil effluent 88, or combinations of these. The gasoline blending effluent 86 may include the pyrolysis gasoline. The steam cracking effluent separation system 80 may further separate the steam cracking effluent into a light cracked gas stream 82. The BTX effluent 84 may include benzene, toluene, xylenes, or combinations of these. Passing the hydrocarbon feed 12 to the distillation system may include passing the hydrocarbon feed 12 to the ADU 12 that separates the hydrocarbon feed 12 into at least the naphtha stream, a diesel stream, and an atmospheric residue through distillation at atmospheric pressure.

Referring now to FIG. 3, the system 100 may include the aromatic bottoms atmospheric distillation unit 60. Any of the processes of the present disclosure may further include passing the portion of the aromatic bottom stream 56 to the aromatic bottoms atmospheric distillation unit 60 downstream of the ARC 50. The aromatic bottoms atmospheric distillation unit 60 may separate the aromatic bottoms stream 56 into at least the lesser boiling effluent 62 and the greater boiling aromatic bottoms effluent 64. The processes may further include passing the greater boiling aromatic bottoms effluent 64 to the steam cracking unit 70. The lesser boiling effluent 62 and the greater boiling aromatic bottoms effluent 64 may have any of the features, compositions, or properties previously described in this disclosure. For example, the lesser boiling effluent 62 may include constituents boiling at temperatures in the naphtha or gasoline boiling range and may include C9 and C10 aromatic compounds from the aromatic bottoms effluent 56. The lesser boiling effluent 62 may include constituents of the aromatic bottoms stream 56 having atmospheric boiling point temperatures less than or equal to 180° C. The greater boiling aromatic bottoms effluent 64 may include constituents boiling at temperatures greater than the gasoline boiling range and may include C11+ aromatic compounds from the aromatic bottoms stream 56. The greater boiling aromatic bottoms effluent 64 may comprise constituents of the aromatic bottoms stream 56 having atmospheric boiling point temperatures greater than 180° C. The processes may further include passing the lesser boiling effluent 62 to a gasoline pool.

Referring now to FIGS. 4 and 5, the system 100 may include the HDA 110, which may include the hydrodearylation reactor 120 or the hydrodearylation reactor 120 and the hydrodearylated effluent separation system 130 downstream of the hydrodearylation reactor 120. Any of the processes of the present disclosure may further include passing the greater boiling aromatic bottoms effluent 64 to the HDA 110 downstream of the aromatic bottoms atmospheric distillation unit 60. The HDA 110 may contact the portion of the greater boiling aromatic bottoms effluent 64 with hydrogen 122 in the presence of a hydrodearylation catalyst to cause at least a portion of the aromatic compounds in the greater boiling aromatic bottoms effluent 64 to undergo hydrodearylation to produce the hydrodearylated effluent 124. The greater boiling aromatic bottoms effluent 64 may be contacted with hydrogen 122 in the presence of the hydrodearylation catalyst in the hydrodearylation reactor 120.

Any of the processes of the present disclosure may further include passing at least a portion of the hydrodearylated effluent 124 to the steam cracking unit 70. The processes may further include passing the hydrodearylated effluent 124 to the hydrodearylated effluent separation system 130 which can separate the hydrodearylated effluent 124 into at least a gasoline fraction 132 and a hydrodearylation bottoms effluent 134 and passing the hydrodearylation bottoms effluent 134 to the steam cracking unit 70. The gasoline fraction 132 may comprise constituents of the hydrodearylated effluent 124 having atmospheric boiling point temperatures less than or equal to 180° C. and may include monoaromatic compounds. The processes may further include passing the gasoline fraction 132 to the gasoline pool. The hydrodearylation bottoms effluent 134 may comprise constituents of the hydrodearylated effluent 124 having atmospheric boiling point temperatures greater than 180° C. and may include C11+ aromatic compounds.

Although shown in FIGS. 4 and 5 as being downstream of the aromatic bottoms atmospheric distillation unit 60, the HDA 110 may be directly downstream of and in fluid communication with the ARC 50. Any of the processes of the present disclosure may include passing the aromatic bottoms stream 56 directly to the HDA 110 downstream of the ARC 50. The HDA 110 may contact the aromatic bottoms stream 56 with hydrogen 122 in the presence of the hydrodearylation catalyst to cause at least a portion of the aromatic compounds in the aromatic bottoms stream 56 to undergo hydrodearylation to produce the hydrodearylated effluent 124. The processes may further include passing at least a portion of the hydrodearylated effluent 124 to the steam cracking unit 70. The processes may further include passing the hydrodearylated effluent 124 to the hydrodearylated effluent separation system 130 that separates the hydrodearylated effluent 124 into at least the gasoline fraction 132 and the hydrodearylation bottoms effluent 134 and passing the hydrodearylation bottoms effluent 134 to the steam cracking unit 70.

Referring again to FIG. 1, process for separating and upgrading hydrocarbon feeds 12 may include separating the hydrocarbon feed into at least the naphtha stream 14 and the residue 18, hydrotreating the naphtha stream 14 to produce a hydrodtreated naphtha 24, reforming the hydrotreated naphtha 24 to produce a reformate 42, processing the reformate 42 to recover at least one aromatics product stream 52 and produce an aromatic bottoms stream 56, and steam cracking at least a portion or all of the aromatic bottoms stream 56 to produce a steam cracking effluent 76 that may include light hydrocarbon gases, gasoline blending components (pyrolysis gasoline), benzene, toluene, xylenes, pyrolysis fuel oils, or combinations of these. Separating the hydrocarbon feed 12 may include distilling the hydrocarbon feed 12 under atmospheric pressure to produce the naphtha stream 14. Hydrotreating the naphtha stream 14 may include contacting the naphtha stream 14 with hydrogen 22 in the presence of a hydrotreating catalyst at the disclosed reaction conditions sufficient to remove nitrogen compounds, sulfur compounds, or both from the naphtha stream 14 to produce the hydrotreated naphtha 24. Reforming the hydrotreated naphtha may include contacting the hydrotreated naphtha 24 with one or more reforming catalysts at the disclosed reaction conditions that are sufficient to cause at least a portion of the hydrotreated naphtha 24 to undergo one or more reforming reactions to produce a reforming effluent. The process may include separating the reforming effluent to produce the reformate 42 and a hydrogen stream 44. The process may include passing at least a portion of the reformate 42 to the gasoline pool. Processing the reformate 42 may include separating, reacting, or both, portions of the reformate 42 in the ARC 50 to produce the at least one aromatic products stream 52 and the aromatic bottoms stream 56. The processing of the reformate may also produce a gasoline pool stream 54.

Steam cracking the aromatic bottoms stream 56 may include contacting all or at least a portion of the aromatic bottoms stream 56 with steam at the reaction conditions previously disclosed in the present disclosure. The contacting may cause at least a portion of the hydrocarbons in the aromatic bottoms stream 56, such as greater than or equal to 10 wt. %, greater than or equal to 20 wt. %, or greater than or equal to 30 wt. % of the hydrocarbons passed into contact with the steam, to undergo cracking reactions to produce the steam cracking effluent 76. The processes may further include separating the steam cracking effluent 76 to produce a light gas effluent 82, a BTX effluent 84, a gasoline blending effluent 86, and at least one pyrolysis fuel oil 88.

The processes may further include separating the aromatic bottoms effluent 56 into at least the lesser boiling effluent 62 and the greater boiling aromatic bottoms effluent 64 and steam cracking the greater boiling aromatic bottoms effluent 64. Separating the aromatic bottoms effluent 56 may include distilling or fractionating the aromatic bottoms effluent 56 at atmospheric pressure. The processes may further include hydrodearylating the greater boiling aromatic bottoms effluent 64 or the aromatic bottoms effluent 56 to produce a hydrodearylated effluent 124 and steam cracking all or at least a portion of the hydrodearylated effluent 124. Hydrodearylating the greater boiling aromatic bottoms effluent 64 or the aromatic bottoms effluent 56 may include contacting the greater boiling aromatic bottoms effluent 64 or the aromatic bottoms effluent 56 with hydrogen in the presence of a hydrodearylation catalyst at the reaction conditions previously discussed in the present disclosure, where contacting causes at least a portion of the alkyl-linked aromatic compounds in the greater boiling aromatic bottoms effluent 64 or the aromatic bottoms effluent 56 to undergo hydrodearylation to produce the hydrodearylated effluent 124. The process may further include separating the hydrodearylated effluent 124 to produce a gasoline fraction 132 and a hydrodearylated bottoms stream 134 and steam cracking the hydrodearylated bottoms stream 134.

EXAMPLES

The various embodiments of methods and systems and process for separating and upgrading hydrocarbon feeds will be further clarified by the following examples. The examples are illustrative in nature, and should not be understood to limit the subject matter of the present disclosure.

In these examples, an aromatic bottoms stream from an aromatic recovery complex was subjected to hydrodearylation at a temperature of 300° C. and pressure of 2500 kPa (25 bar) to produce a hydrodearlylated effluent. The hydrodearylated effluent was then used as a feed to a steam cracking process. The composition and properties of the aromatic bottoms stream and the hydrodearylated effluent following hydrodearylation are provided below in Table 2.

TABLE 2

Compositions and Properties of the Feed to the Steam Cracking Unit.

| Property/Composition | Units | Aromatic Bottoms Eff. | Hydrodearylated Effluent |
|---|---|---|---|
| Specific Gravity | — | 0.9819 | 0.8785 |
| Paraffin Compounds | weight percent (wt.%) | 0.03 | 0.40 |
| Mononaphthenes | wt. % | 0.53 | 1.72 |
| Dinaphthenes | 0.35 | 1.22 | |
| Monoaromatic Compounds | 13.59 | 90.29 | |
| Naphthelenic Monoaromatic Compounds | wt. % | 11.33 | 3.90 |
| Diaromatic Compounds | 61.44 | 1.66 | |
| Naphthenic Diaromatic Compounds | wt. % | 7.82 | 0.70 |
| Tri/tetra Aromatic Compounds | wt. % | 4.91 | 0.11 |
| Benzene | wt. % | 0.01 | 0.06 |
| Toluene | wt. % | 0.04 | 0.27 |
| C8 Aromatic Compounds | wt. % | 0.01 | 0.87 |
| IBP | ° C. | 198 | 138 |
| BP 5 wt. % | ° C. | 207 | 163 |
| BP 10 wt. % | ° C. | 211 | 165 |
| BP 30 wt. % | ° C. | 236 | 167 |
| BP 50 wt. % | ° C. | 275 | 173 |
| BP 70 wt. % | ° C. | 303 | 175 |
| BP 90 wt. % | ° C. | 332 | 192 |
| BP 95 wt. % | ° C. | 351 | 206 |
| FBP | ° C. | 445 | 313 |

The hydrodearylated effluent was then subjected to steam cracking in a bench scale steam cracking system comprising a coil steam cracking reactor. The steam cracking unit was operated at a coil outlet temperature of 800° C. and a coil outlet pressure of 150 kPa (1.5 bar) and 200 kPa (2.0 bar). The mass flow rate of the hydrocarbon feed comprising the hydrodearylated effluent of Table 2 was set at a fixed rate corresponding to a residence time in the coil reactor of from 0.7 to 1.0 seconds. The steam dilution factor was set to 0.6 kilograms of steam per kilogram of hydrocarbons per second ($kg_{H2O}/(kg_{HC}*s)$). The steam cracking effluent was collected and analyzed for composition according to known methods. The composition for the steam cracking effluent at 150 kPa and 200 kPa operating pressure are provided in Table 3.

TABLE 3

Composition of Steam Cracking Effluent.

| Constituent | P = 150 kPa (wt.%) | P = 200 kPa (wt.%) |
|---|---|---|
| Hydrogen ($H_2$) | 0.16 | 0.20 |
| Methane ($CH_4$) | 1.55 | 1.94 |
| Carbon Monoxide | 0.03 | 0.03 |
| Ethylene ($C_2H_4$) | 1.03 | 1.18 |
| Propene ($C_3H_6$) | 0.23 | 0.21 |
| 1-Butene | 0.02 | 0.01 |
| 1,3-Butadiene | 0.07 | 0.06 |
| Benzene | 0.46 | 0.65 |
| Toluene | 4.63 | 5.63 |
| Styrene | 2.32 | 2.47 |
| Xylenes | 13.49 | 15.56 |
| Pygas (C5-C9) | 55.71 | 52.32 |
| Pyrolysis Fuel Oil (PFO C10+) | 20.30 | 19.74 |
| Total | 100.00 | 100.00 |

Comparison of the composition of the hydrodearylated effluent in Table 2 to the steam cracking effluent in Table 3 demonstrates that passing a portion of the hydrodearylated effluent, which comprises an aromatic bottoms stream that has been subjected to hydrodearylation, to a steam cracking unit can increase the yield of benzene, toluene, and xylenes (BTX) from the process by 17.4 wt. % BTX for 150 kPa and 20.6 wt. % BTX for 200 kPa based on the total weight of the stream cracking effluent compared to the BTX in the hydrodearylated effluent. Thus, passing a portion of the aromatic bottom stream, such as an aromatic bottoms stream from an ARC or an aromatic bottoms stream subjected to hydrodearylation, can greatly increase the yield of valuable aromatic compounds and intermediates, such as benzene, toluene, and xylenes, from the system 100.

A first aspect of the present disclosure may include a process for separating and upgrading a hydrocarbon feed. The process may include passing the hydrocarbon feed to a distillation system that may separate the hydrocarbon feed into at least a naphtha stream and a residue, passing the naphtha stream to a naphtha hydrotreating unit to hydrotreat the naphtha stream to produce a hydrotreated naphtha, passing the hydrotreated naphtha to a naphtha reforming unit that may reform the hydrotreated naphtha to produce at least a reformate, passing the reformate to an aromatics recovery complex that may process the reformate to produce at least one aromatic product effluent and an aromatic bottoms stream, passing at least a portion of the aromatic bottoms stream to a steam cracking unit to crack at least a portion of the aromatic bottoms stream to produce a steam cracking effluent comprising light hydrocarbon gases, pyrolysis fuel oil, gasoline blending components, benzene, toluene, xylenes, or combinations of these.

A second aspect of the present disclosure may include the first aspect, where the portion of the aromatic bottoms stream passed to the steam cracking unit may comprise constituents having boiling point temperatures greater than 150 degrees Celsius.

A third aspect of the present disclosure may include either one of the first or second aspects, where the portion of the aromatic bottoms stream passed to the steam cracking unit may comprise C9+ aromatic compounds. The portion of the aromatic bottoms stream passed to the steam cracking unit may comprise C11+ aromatic compounds.

A fourth aspect of the present disclosure may include any one of the first through third aspects, where the portion of the aromatic bottoms stream passed to the steam cracking unit may comprise greater than or equal to 50 weight percent C9+ aromatic compounds based on the total weight of the aromatic bottoms stream.

A fifth aspect of the present disclosure may include any one of the first through fourth aspects, where the portion of the aromatic bottom stream passed to the steam cracking unit may comprise C11+ aromatic compounds.

A sixth aspect of the present disclosure may include any one of the first through fifth aspects, where the portion of the aromatic bottoms stream passed to the steam cracking unit may comprise greater than or equal to 50 weight percent C11+ compounds based on the total weight of the aromatic bottoms stream.

A seventh aspect of the present disclosure may include any one of the first through sixth aspects, further comprising passing the steam cracking effluent to a steam cracking effluent separation system to separate the steam cracking effluent into at least a BTX effluent, a gasoline blending effluent, a pyrolysis fuel oil effluent, or combinations of these.

An eighth aspect of the present disclosure may include the seventh aspect, where the BTX effluent may comprise benzene, toluene, xylenes, or combinations of these.

A ninth aspect of the present disclosure may include either one of the seventh or eighth aspects, where the steam cracking effluent separation system separates the steam cracking effluent into at least a light gas effluent, the BTX effluent, the gasoline blending effluent, and the pyrolysis fuel oil effluent.

A tenth aspect of the present disclosure may include any one of the first through ninth aspects, in which the distillation system may comprise an atmospheric distillation unit which separates the hydrocarbon feed into at least the naphtha stream, a diesel stream, and an atmospheric residue.

An eleventh aspect of the present disclosure may include any one of the first through tenth aspects, further comprising passing the portion of the aromatic bottoms stream to an aromatic bottoms atmospheric distillation unit downstream of the aromatics recovery complex. The aromatic bottoms atmospheric distillation unit may separate the portion of the aromatic bottoms stream into at least a lesser boiling effluent and a greater boiling aromatic bottoms effluent. The process may further include passing the greater boiling aromatic bottoms effluent to the steam cracking unit.

A twelfth aspect of the present disclosure may include the eleventh aspect, where the lesser boiling effluent may comprise constituents of the aromatic bottoms stream having atmospheric boiling point temperatures less than or equal to 180° C. and the greater boiling aromatic bottoms effluent may comprise constituents of the aromatic bottoms stream having atmospheric boiling point temperatures greater than 180° C.

A thirteenth aspect of the present disclosure may include either one of the eleventh or twelfth aspects, where the lesser boiling effluent may comprise C9 and C10 compounds and the greater boiling aromatic bottoms effluent may comprise C11+ aromatic compounds.

A fourteenth aspect of the present disclosure may include any one of the eleventh through thirteenth aspects, further comprising passing the lesser boiling effluent to a gasoline pool or to a transaklkylation unit downstream of the aromatic bottoms atmospheric distillation unit.

A fifteenth aspect of the present disclosure may include any one of the eleventh through fourteenth aspects, further comprising passing the greater boiling aromatic bottoms effluent to a hydrodearylation unit downstream of the aromatic bottoms atmospheric distillation unit. The hydrodearylation unit may contact the portion of the greater boiling aromatic bottoms effluent with hydrogen in the presence of a hydrodearylation catalyst to cause at least a portion of the aromatic compounds in the greater boiling aromatic bottoms effluent to undergo hydrodearylation to produce a hydrodearylated effluent. The process may further include passing at least a portion of the hydrodearylated effluent to the steam cracking unit.

A sixteenth aspect of the present disclosure may include the fifteenth aspect, further comprising passing the hydrodearylated effluent to a hydrodearylated effluent separation system that may separate the hydrodearylated effluent into at least a gasoline fraction and a hydrodearylation bottoms effluent and passing the hydrodearylation bottoms effluent to the steam cracking unit.

A seventeenth aspect of the present disclosure may include any one of the first through tenth aspects, further comprising passing the aromatic bottoms stream to a hydrodearylation unit downstream of the aromatics recovery complex. The hydrodearylation unit may contact the aromatic bottoms stream with hydrogen in the presence of a hydrodearylation catalyst to cause at least a portion of the aromatic compounds in the aromatic bottoms stream to undergo hydrodearylation to produce a hydrodearylated effluent. The process may further include passing at least a portion of the hydrodearylated effluent to the steam cracking unit.

An eighteenth aspect of the present disclosure may include the seventeenth aspect, further comprising passing the hydrodearylated effluent to a hydrodearylated effluent separation system that may separate the hydrodearylated effluent into at least a gasoline fraction and a hydrodearylation bottoms effluent and passing the hydrodearylation bottoms effluent to the steam cracking unit.

A nineteenth aspect of the present disclosure may include either one of the seventeenth or eighteenth aspects, where the gasoline fraction may comprise constituents of the hydrodearylated effluent having atmospheric boiling point temperatures less than or equal to 180° C.

A twentieth aspect of the present disclosure may include any one of the seventeenth through nineteenth aspects, where the gasoline fraction may comprise monoaromatic compounds having less than or equal to 10 carbon atoms.

A twenty-first aspect of the present disclosure may include any one of the seventeenth through twentieth aspects, further comprising passing the gasoline fraction to a gasoline pool, a transalkylation unit downstream of the hydrodearylated effluent separation system, or to the aromatics recovery complex.

A twenty-second aspect of the present disclosure may include any one of the seventeenth through twenty-first aspects, where the hydrodearylation bottoms effluent may comprise constituents of the hydrodearylated effluent having atmospheric boiling point temperatures greater than 180° C.

A twenty-third aspect of the present disclosure may include any one of the seventeenth through twenty-second aspects, where the hydrodearylation bottoms effluent may comprise C11+ aromatic compounds.

A twenty-fourth aspect of the present disclosure may include any one of the first through twenty-third aspects, where the hydrocarbon feed may comprise crude oil.

A twenty-fifth aspect of the present disclosure may include a system for upgrading a hydrocarbon feed. The system may include a distillation system operable to separate the hydrocarbon feed into at least a naphtha stream and a residue, a naphtha hydrotreating unit disposed downstream of the distillation system and operable to contact the naphtha stream with hydrogen in the presence of at least one hydrotreating catalyst to produce a hydrotreated naphtha, a naphtha reforming unit disposed downstream of the naphtha hydrotreating unit and operable to reform the hydrotreated naphtha to produce a reformate, an aromatics recovery complex disposed downstream of the naphtha reforming unit and operable to separate the reformate into at least one aromatic product effluent and an aromatic bottoms stream, and a steam cracking unit downstream of the aromatics recovery complex and operable to receive at least a portion of the aromatic bottoms stream and crack at least a portion of C9+ aromatic compounds from the aromatic bottoms stream to produce a steam cracking effluent comprising one or more of light hydrocarbon gases, pyrolysis fuel oil, pyrolysis gasoline including, benzene, toluene, mixed xylenes, or combinations of these.

A twenty-sixth aspect of the present disclosure may include the twenty-fifth aspect, where the hydrocarbon feed may comprise a crude oil.

A twenty-seventh aspect of the present disclosure may include either one of the twenty-fifth or twenty-sixth aspects, further comprising a steam cracking effluent separation system that may be operable to separate a cracked effluent from the steam cracking unit to produce at least a BTX effluent, a gasoline blending effluent, and a pyrolysis fuel oil effluent.

A twenty-eighth aspect of the present disclosure may include any one of the twenty-fifth through twenty-seventh aspects, where the steam cracking unit may be in direct fluid communication with the aromatics recovery complex to pass the aromatic bottoms stream directly from the aromatics recovery complex to the steam cracking unit.

A twenty-ninth aspect of the present disclosure may include any one of the twenty-fifth through twenty-seventh aspects, further comprising an aromatic bottoms atmospheric distillation unit disposed downstream of the aromatics recovery complex. The aromatic bottoms atmospheric distillation unit may be operable to separate the aromatic bottoms stream to produce at least a lesser boiling effluent and a greater boiling aromatic bottoms effluent.

A thirtieth aspect of the present disclosure may include the twenty-ninth aspect, where the aromatic bottoms atmospheric distillation unit may be in direct fluid communication with the aromatics recovery complex to pass the aromatic bottoms stream directly from the aromatics recovery complex to the aromatic bottoms atmospheric distillation unit.

A thirty-first aspect of the present disclosure may include any one of the twenty-ninth through thirtieth aspects, where the lesser boiling effluent may comprise C9 and C10 aromatic compounds.

A thirty-second aspect of the present disclosure may include any one of the twenty-ninth through thirty-first aspects, where the aromatic bottoms atmospheric distillation unit may be upstream of the steam cracking unit.

A thirty-third aspect of the present disclosure may include any one of the twenty-ninth through thirty-second aspects, where the steam cracking unit may be in direct fluid communication with a greater boiling aromatic bottoms outlet of the aromatic bottoms atmospheric distillation unit to pass the greater boiling aromatic bottoms effluent directly from the aromatic bottoms atmospheric distillation unit to the steam cracking unit.

A thirty-fourth aspect of the present disclosure may include any one of the twenty-fifth through twenty-seventh aspects, further comprising a hydrodearylation unit disposed downstream of the aromatics recovery complex. The hydrodearlyation unit may comprise a hydrodearylation reactor that may be operable to contact at least a portion of the aromatic bottoms stream with hydrogen in the presence of a hydrodearylation catalyst to produce a hydrodearylated effluent.

A thirty-fifth aspect of the present disclosure may include the thirty-fourth aspect, where the hydrodearylation reactor is in direct fluid communication with the steam cracking unit to pass the hydrodearylated effluent directly to the steam cracking unit.

A thirty-sixth aspect of the present disclosure may include the thirty-fourth aspect, further comprising a hydrodearylated effluent separation system disposed downstream of the hydrodearylation reactor and operable to separate the hydrodearylated effluent into at least a gasoline fraction and a hydrodearylation bottoms effluent.

A thirty-seventh aspect of the present disclosure may include the thirty-sixth aspect, where the steam cracking unit is in direct fluid communication with a hydrodearylation bottoms outlet of the hydrodearylated effluent separation system so that the hydrodearylation bottoms effluent may be passed directly from the hydrodearylated effluent separation system to the steam cracking unit.

A thirty-eighth aspect of the present disclosure may include any one of the thirty-fourth through thirty-seventh aspects, where the hydrodearylation unit may be in direct fluid communication with the aromatics recovery complex.

A thirty-ninth aspect of the present disclosure may include any one of the thirty-fourth through thirty-seventh aspects, where the hydrodearylation unit may be disposed downstream of an aromatic bottoms atmospheric distillation unit and upstream of the steam cracking unit.

A fortieth aspect of the present disclosure may include any one of the twenty-fifth through thirty-ninth aspects, in which the distillation system comprises an atmospheric distillation unit.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A process for separating and upgrading a hydrocarbon feed, the process comprising:

passing the hydrocarbon feed to a distillation system that separates the hydrocarbon feed into at least a naphtha stream and a residue;

passing the naphtha stream to a naphtha hydrotreating unit to hydrotreat the naphtha stream to produce a hydrotreated naphtha;

passing the hydrotreated naphtha to a naphtha reforming unit that reforms the hydrotreated naphtha to produce at least a reformate;

passing the reformate to an aromatics recovery complex that processes the reformate to produce at least one aromatic product effluent and an aromatic bottoms stream;

passing at least a portion of the aromatic bottoms stream to a steam cracking unit to crack at least a portion of the aromatic bottoms stream to produce a steam cracking effluent comprising light hydrocarbon gases, pyrolysis fuel oil, gasoline blending components, benzene, toluene, xylenes, or combinations of these.

2. The process of claim 1, where the portion of the aromatic bottoms stream passed to the steam cracking unit comprises constituents having boiling point temperatures greater than 150 degrees Celsius.

3. The process of claim 1, where the portion of the aromatic bottom stream passed to the steam cracking unit comprises C9+ aromatic compounds.

4. The process of claim 1, where the hydrocarbon feed comprises crude oil.

5. The process of claim 1, further comprising passing the steam cracking effluent to a steam cracking effluent separation system to separate the steam cracking effluent into at least a BTX effluent, a gasoline blending effluent, a pyrolysis fuel oil effluent, or combinations of these, where the BTX effluent comprises benzene, toluene, xylenes, or combinations of these.

6. The process of claim 1, further comprising:

passing the portion of the aromatic bottoms stream to an aromatic bottoms atmospheric distillation unit downstream of the aromatics recovery complex, where the aromatic bottoms atmospheric distillation unit separates the portion of the aromatic bottoms stream into at least a lesser boiling effluent and a greater boiling aromatic bottoms effluent; and passing the greater boiling aromatic bottoms effluent to the steam cracking unit.

7. The process of claim 6, where the lesser boiling effluent comprises C9 and C10 compounds and the greater boiling aromatic bottoms effluent comprises C11+ aromatic compounds.

8. The process of claim 6, further comprising:

passing the greater boiling aromatic bottoms effluent to a hydrodearylation unit downstream of the aromatic bottoms atmospheric distillation unit, where the hydrodearylation unit contacts the portion of the greater boiling aromatic bottoms effluent with hydrogen in the presence of a hydrodearylation catalyst to cause at least a portion of the aromatic compounds in the greater boiling aromatic bottoms effluent to undergo hydrodearylation to produce a hydrodearylated effluent; and passing at least a portion of the hydrodearylated effluent to the steam cracking unit.

9. The process of claim 8, further comprising:

passing the hydrodearylated effluent to a hydrodearylated effluent separation system which separates the hydrodearylated effluent into at least a gasoline fraction and a hydrodearylation bottoms effluent; and passing the hydrodearylation bottoms effluent to the steam cracking unit.

10. The process of claim 1, further comprising:

passing the aromatic bottoms stream to a hydrodearylation unit downstream of the aromatics recovery complex, where the hydrodearylation unit contacts the aromatic bottoms stream with hydrogen in the presence of a hydrodearylation catalyst to cause at least a portion of the aromatic compounds in the aromatic bottoms stream to undergo hydrodearylation to produce a hydrodearylated effluent; and passing at least a portion of the hydrodearylated effluent to the steam cracking unit.

11. The process of claim 10, further comprising:

passing the hydrodearylated effluent to a hydrodearylated effluent separation system that separates the hydrodearylated effluent into at least a gasoline fraction and a hydrodearylation bottoms effluent comprising C11+ aromatic compounds; and passing the hydrodearylation bottoms effluent to the steam cracking unit.

12. A system for upgrading a hydrocarbon feed, the system comprising:

a distillation system operable to separate the hydrocarbon feed into at least a naphtha stream and a residue;

a naphtha hydrotreating unit disposed downstream of the distillation system and operable to contact the naphtha stream with hydrogen in the presence of at least one hydrotreating catalyst to produce a hydrotreated naphtha;

a naphtha reforming unit disposed downstream of the naphtha hydrotreating unit and operable to reform the hydrotreated naphtha to produce a reformate;

an aromatics recovery complex disposed downstream of the naphtha reforming unit and operable to separate the reformate into at least one aromatic product effluent and an aromatic bottoms stream; and a steam cracking unit downstream of the aromatics recovery complex and operable to receive at least a portion of the aromatic bottoms stream and crack at least a portion of C9+ aromatic compounds from the aromatic bottoms stream to produce a steam cracking effluent comprising one or more of light hydrocarbon gases, pyrolysis fuel oil, pyrolysis gasoline, including, benzene, toluene, mixed xylenes, or combinations of these.

13. The system of claim 12, further comprising a steam cracking effluent separation system operable to separate a cracked effluent from the steam cracking unit to produce at least a BTX effluent, a gasoline blending effluent, and a pyrolysis fuel oil effluent.

14. The system of claim 12, where the steam cracking unit is in direct fluid communication with the aromatics recovery complex to pass the aromatic bottoms stream directly from the aromatics recovery complex to the steam cracking unit.

15. The system of claim 12, further comprising an aromatic bottoms atmospheric distillation unit disposed downstream of the aromatics recovery complex, the aromatic bottoms atmospheric distillation unit operable to separate the aromatic bottoms stream to produce at least a lesser boiling effluent and a greater boiling aromatic bottoms effluent.

16. The system of claim 15, where the steam cracking unit is in direct fluid communication with an outlet of the aromatic bottoms atmospheric distillation unit to pass the greater boiling aromatic bottoms effluent directly from the aromatic bottoms atmospheric distillation unit to the steam cracking unit.

17. The system of claim 12, further comprising a hydrodearylation unit disposed downstream of the aromatics recovery complex, the hydrodearlyation unit comprising a hydrodearylation reactor operable to contact at least a portion of the aromatic bottoms stream with hydrogen in the presence of a hydrodearylation catalyst to produce a hydrodearylated effluent.

18. The system of claim 17, further comprising:

a hydrodearylated effluent separation system disposed downstream of the hydrodearylation reactor and operable to separate the hydrodearylated effluent into at least a gasoline fraction and a hydrodearylation bottoms effluent;

where the steam cracking unit is in direct fluid communication with a hydrodearylation bottoms outlet of the hydrodearylated effluent separation system so that the hydrodearylation bottoms effluent is passed directly from the hydrodearylated effluent separation system to the steam cracking unit.

19. The system of claim 17, where the hydrodearylation unit is in direct fluid communication with the aromatics recovery complex.

20. The system of claim 17, where the hydrodearylation unit is disposed downstream of an aromatic bottoms atmospheric distillation unit and upstream of the steam cracking unit.

* * * * *